US007330087B2

(12) United States Patent
Gorovoy et al.

(10) Patent No.: US 7,330,087 B2
(45) Date of Patent: Feb. 12, 2008

(54) MICROWAVE SWITCH HOUSING ASSEMBLY

(75) Inventors: Evgeni Gorovoy, Waterloo (CA); Jeffrey M. Wiesel, Cambridge (CA)

(73) Assignee: Com Dev Ltd., Cambridge (CA)

( * ) Notice: Subject to any disclaimer, the term of this patent is extended or adjusted under 35 U.S.C. 154(b) by 559 days.

(21) Appl. No.: 10/787,312

(22) Filed: Feb. 27, 2004

(65) Prior Publication Data

US 2005/0190010 A1 Sep. 1, 2005

(51) Int. Cl.
*H01P 1/10* (2006.01)
*H01P 5/12* (2006.01)

(52) U.S. Cl. ..... 333/106; 333/108

(58) Field of Classification Search ..... 333/101, 333/106, 108

See application file for complete search history.

(56) References Cited

U.S. PATENT DOCUMENTS 3,155,923 A 11/1964 Persson
3,243,733 A 3/1966 Hosman
4,242,652 A 12/1980 Shishido et al.
4,649,355 A 3/1987 Ullman
4,806,887 A 2/1989 Au-Yeung
4,967,170 A * 10/1990 Hettlage et al. ..... 333/106
6,218,912 B1 4/2001 Mayer
6,380,822 B1 4/2002 Lindgren

FOREIGN PATENT DOCUMENTS

DE 40 34 683 A1 5/1992
GB 1 034 802 A 7/1966
GB 1 255 506 A 12/1971
GB 2250140 A * 10/1990

* cited by examiner

*Primary Examiner*—Dean Takaoka
(74) *Attorney, Agent, or Firm*—Bereskin & Parr; Isis E. Caulder

(57) ABSTRACT

A microwave switch housing assembly for operation in a selected frequency range. The housing assembly includes a housing having ports, a rotor containing at least one waveguide passage, and power absorbing material positioned either in the housing or in the rotor. Ports are positioned within the housing it so that in a first position of the rotor, the waveguide passage connects the ports and in a second position of the rotor, the waveguide passage is unconnected to the ports. The power absorbing material is positioned adjacent to one end of said waveguide passage when said rotor is in said second position it absorbs electromagnetic energy in the frequency range and reduces the tendency of the isolation passage to act as a volume resonator when the rotor is in the second position.

17 Claims, 15 Drawing Sheets

MICROWAVE SWITCH HOUSING ASSEMBLY

FIELD OF THE INVENTION

This invention relates to a microwave switch and more particularly to an improved microwave switch housing assembly that reduces spurious resonant spikes in the isolation and insertion loss characteristics between unconnected waveguide ports.

BACKGROUND OF THE INVENTION

Microwave switches are used in a variety of applications. For example, in satellite technology, microwave rotary switches (R-switches) and C-switches are widely used as redundant switches to connect a spare device when an active device malfunctions. Typically, large numbers of R-switches and C-switches are employed in a satellite system.

FIG. 1 illustrates the cross-section of a typical microwave R-switch assembly 10 includes a housing 2 (also known as a "stator") having waveguide ports 14A, 14B, 14C and 14D and a hollow cylindrical interior 16, and a cylindrical rotor 18 within the housing 2. Rotor 18 typically has three waveguide paths, a straight central waveguide passage 11, and two curved waveguide passages 8 and 12 that connect various waveguide ports depending on the specific position of rotor 18 within housing 2. An actuator (not shown) is used to move the rotor to various predetermined positions. Also, in microwave R-switches and C-switches, it is necessary to provide a physical clearance gap between the rotor and the housing so that the rotor may be rotated within the housing. As shown, a physical clearance gap G between the outer surface of the rotor 18 and the inner surface of the housing 2 exists to allow the rotor 18 to rotate unobstructed within housing 2.

When an electromagnetic signal is propagating from a connected port 14B at one end of a switched-through waveguide passage 11 to another connected port 14D at the other end of the waveguide passage 11, leakage of some of the electromagnetic signal through clearance gap G typically causes the unconnected ports 14A and 14C to show an electromagnetic signal, thus degrading the isolation and the insertion loss performance of the microwave switch. Essentially, the gap G acts as a transmission line and since the gap G encompasses the entire circumference of the rotor 18, the electromagnetic signal can be indicated at various ports within housing 2. Also, the not-switched-through waveguide passages 8 and 12 and the inner surface of housing 2 adjacent to waveguide passages 8 and 12 form a volume resonator. If the frequency of the signal passing through the switched-through waveguide passage 11 is close to the resonant frequency of these volume resonators, a signal will appear at the unconnected ports 14A and 14C characterized by a spurious narrow spike in the isolation and insertion loss characteristics around the resonant frequency.

It is important to achieve a high degree of mutual isolation of unconnected ports 14A, 14B, 14C and 14D. For example, in the case of redundancy circuit networks for application within satellite systems, the ratio of the power occurring at a port that is not connected any other port (e.g. 14A), to the power supplied to a port (e.g. 14B) that is connected with another port (e.g. 14D), should be at least as low as approximately −60 dB. This power ratio requirement is applicable to R-switches having any number of ports 14. Mutual isolation of unconnected ports is conventionally achieved in two ways.

One approach is to narrow the gap G in order to reduce the electromagnetic signal leakage through gap G. However, this approach is limited by mechanical and thermal requirements and reliability concerns. Specifically, if the gap is narrowed too much, it is not possible to provide housing assembly 10 that functions at an acceptable level over a reasonable range of operating temperatures due to thermal expansion characteristics of rotor 18 and housing 2.

Another approach is to provide longitudinal and circumferential grooves on the surface of the rotor and/or by providing grooves on the inner surface of the housing. For example, in U.S. Pat. No. 3,155,923 to Persson, U.S. Pat. No. 4,649,355 to Ullman, and U.S. Pat. No. 6,218,912 to Mayer, the isolation of unconnected ports can be improved using such methods and result in a ratio of even less than −60 dB. However, the use of such grooves on the inner surface of the housing does not appear in practice to eliminate the appearance of the spurious narrow spike. The inventors have determined that in practice, the spurious narrow spike still can have an amplitude in the range −35 to −40 dB. In addition, the provision of longitudinal and circumferential grooves adds to the complexity and manufacturing cost of producing housing assembly 10.

BRIEF SUMMARY OF THE INVENTION

In one aspect the present invention provides a microwave switch housing assembly for operation in a selected frequency range, comprising:

(a) a housing;

(b) a rotor rotatably mounted within said housing;

(c) at least one waveguide passage in said rotor;

(d) said housing having ports formed therein so that in a first position of said rotor, said waveguide passage connects said ports and in a second position of said rotor, said waveguide passage is unconnected to said ports;

(e) a power absorbing element located within one of said housing and said rotor such that said power absorbing element is positioned adjacent to one end of said waveguide passage when said rotor is in said second position;

(f) said power absorbing element being capable of absorbing electromagnetic energy in said frequency range, so as to reduce the tendency of said waveguide passage to act as a volume resonator when said rotor is in said second position.

Further aspects and advantages of the invention will appear from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show some examples of the present invention, and in which.

Figure 1:
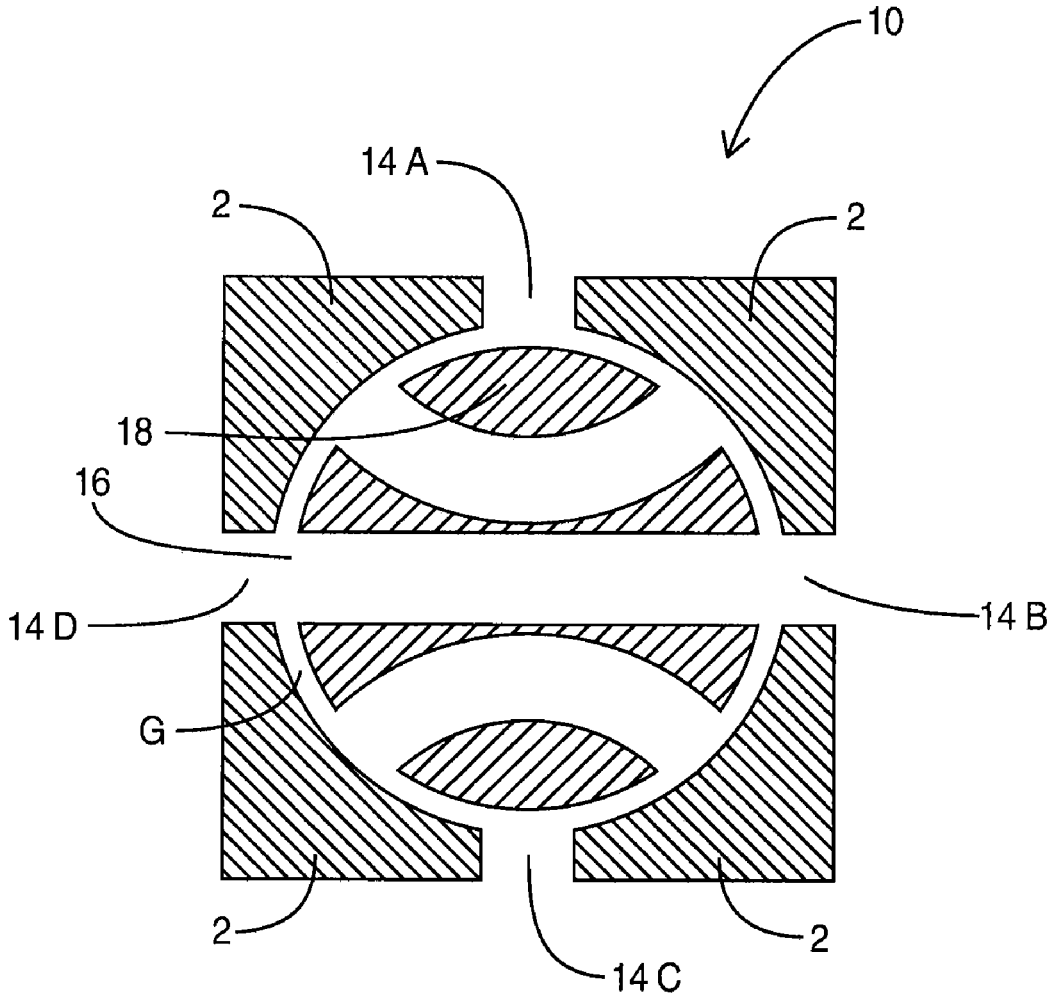
FIG. 1 (PRIOR ART)
FIG. 1 is a cross-sectional schematic view of a prior art microwave R-switch showing potential leakage paths.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

Figure 2:
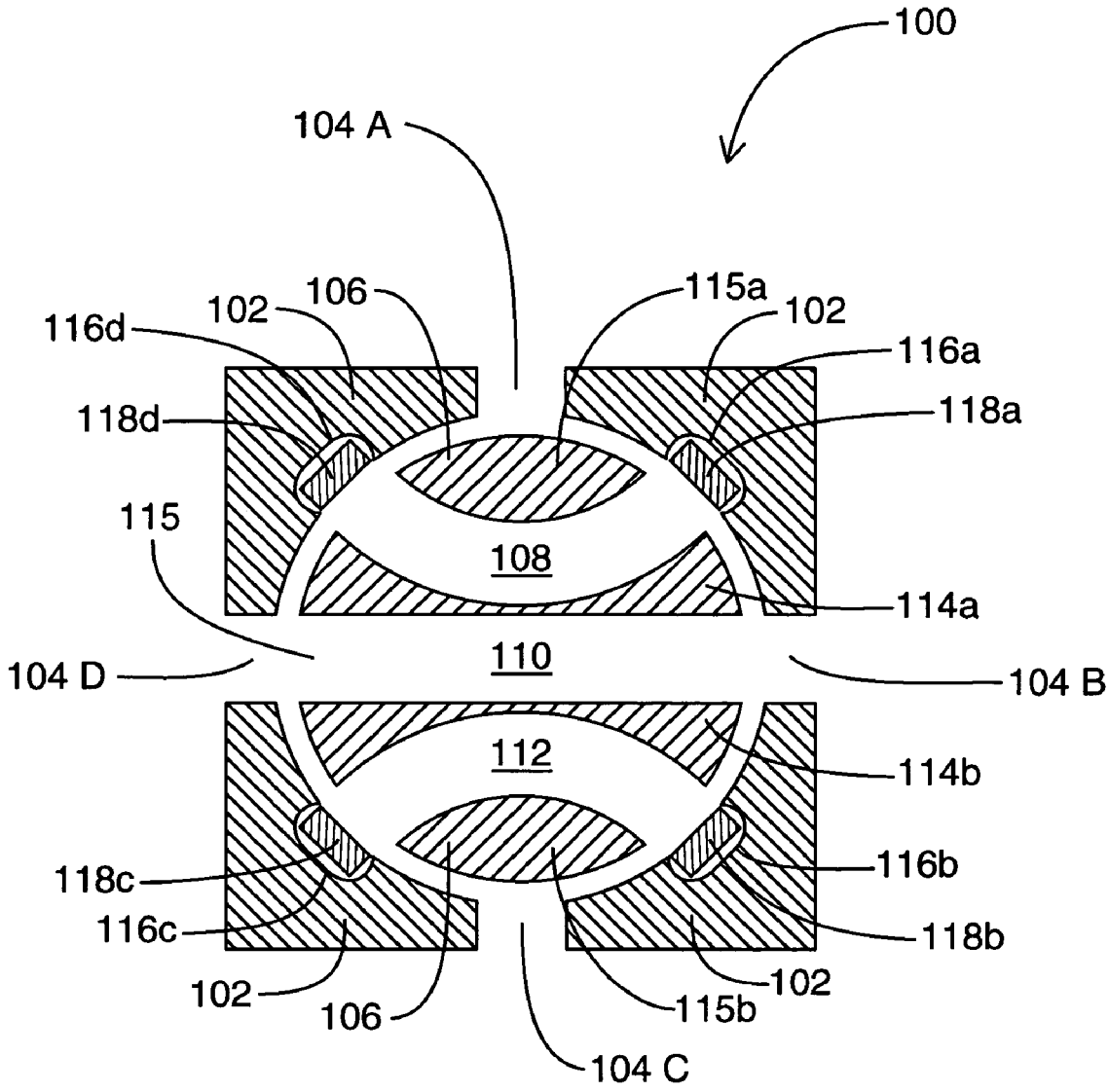
FIG. 2 is a cross-sectional view of an example microwave R-switch of the present invention.

FIG. 2 is a cross-sectional view of an example microwave R-switch assembly 100 built in accordance with the present invention. Microwave switch 100 includes a housing 102 having an internal open space 115 and waveguide ports 104A, 104B, 104C and 104D, and a rotor 106 disposed within the internal open space of housing 102. Rotor 106 includes curved waveguide passages 108, 112 and straight waveguide passage 110. Each waveguide passage 108, 110, 112, is designed to selectively line up with waveguide ports 104A, 104B, 104C and 104D as rotor 106 rotates within housing 102. An actuator (not shown) is used in a conventional way to move the R-switch to various predetermined positions. Channels 116*a*, 116*b*, 116*c*, 116*d* are formed within housing 102 and are adapted to house power absorbing elements 118*a*, 118*b*, 118*c*, 118*d* manufactured out of material that absorbs electromagnetic power. As rotor 106 rotates within housing 102, four predetermined switch positions can be achieved. Power absorbing elements 118*a*, 118*b*, 118*c*, 118*d* are positioned within channels 116*a*, 116*b*, 116*c*, 116*d* and used to absorb electromagnetic power generated by the resonant oscillations present within unconnected waveguide passages as will described.

Rotor 106 includes center portions 114*a* and 114*b* and side portions 115*a* and 115*b*. Center portion 114*a* is positioned between waveguide passages 108 and 110, and center portion 114*b* is positioned between waveguide passages 110 and 112. Side portions 115*a* and 115*b* are positioned on the other side of waveguide passages 108 and 112 from center portions 114*a* and 114*b*. Waveguide passages 108, 110 and 112 when aligned with ports 104A, 104B, 104C, and 104D in housing 102, allow propagation of electromagnetic energy (i.e. provide a electromagnetic wave propagation path), having a wavelength that corresponds to the dimension of the ports. Center portions 114*a* and 114*b* and side portions 115*a* and 115*b* are preferably manufactured out of conductive material (e.g. a suitable metal such as aluminum, copper, brass or another metal plated with gold or silver, or chemical coated surface) to establish a waveguide transmission line with no crosstalk between waveguide passages.

Housing 102 is a conventional machined microwave switch housing containing waveguide ports 104A, 104B, 104C, and 104D and a rotor-accepting cylindrical cavity 115. Ports 104A, 104B, 104C, 104D, that are not coupled through a waveguide path will be described as mutually isolated. Ports 104A, 104B, 104C and 104D, that are coupled through a waveguide path will be described as mutually connected. Conventional waveguide connecting flanges (not shown) are easily attached to housing 102 at appropriate port locations as conventionally known. Housing 102 also contains four longitudinal channels 116*a*, 116*b*, 116*c*, 116*d* that are adapted to house four longitudinal power absorbing elements 118*a*, 118*b*, 118*c* and 118*d*. As shown in FIG. 2, channels 116*a*, 116*b*, 116*c* and 116*d* are positioned radially outwardly from the internal open space of housing 102. Each channel 116*a*, 116*b*, 116*c* and 116*d* has an open side that communicates with the internal open space of housing 102. Each channel 116*a*, 116*b*, 116*c* and 116*d* is positioned within housing 102 such that power absorbing elements 118*a*, 118*b*, 118*c*, 118*d* are located within channels 116*a*, 116*b*, 116*c*, 116*d* are able to absorb electromagnetic power between mutually isolated ports such that resonant oscillations are suppressed. Housing 102 is preferably manufactured from aluminum, however it should be understood that other materials could be utilized (e.g. a suitable metal such as aluminum, copper, brass or another metal plated with gold or silver, or chemical coated surface).

Figure 3A:
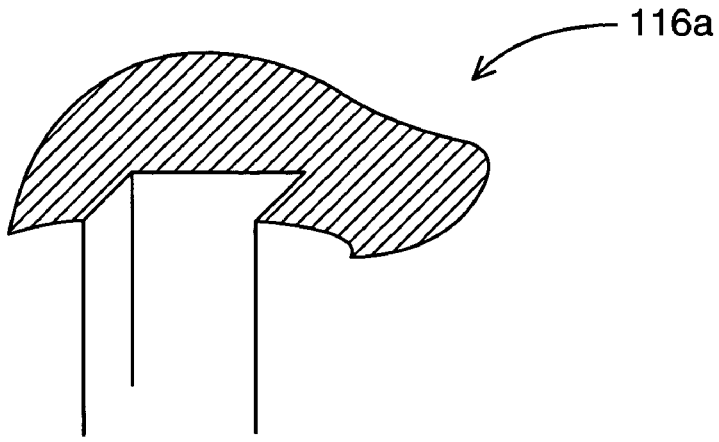
FIGS. 3A, 3B, 3C and 3D are perspective views of various channels utilized within the example microwave switches of FIGS. 2 and 8.
Figure 3B:
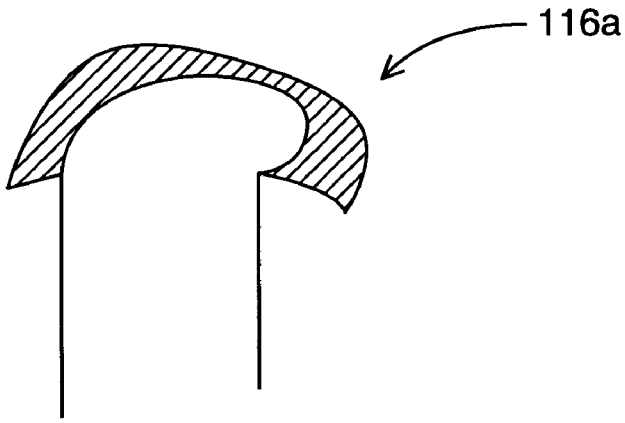
Figure 3C:
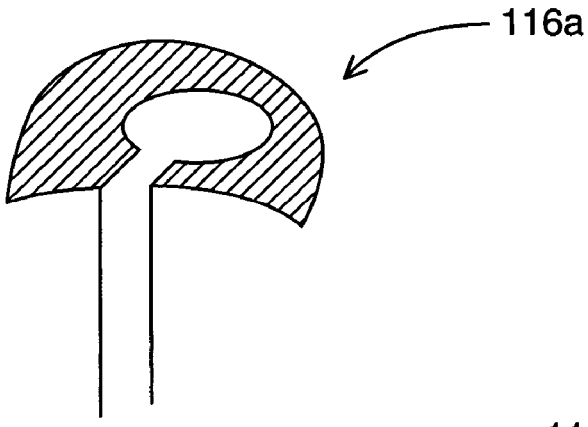
Figure 3D:
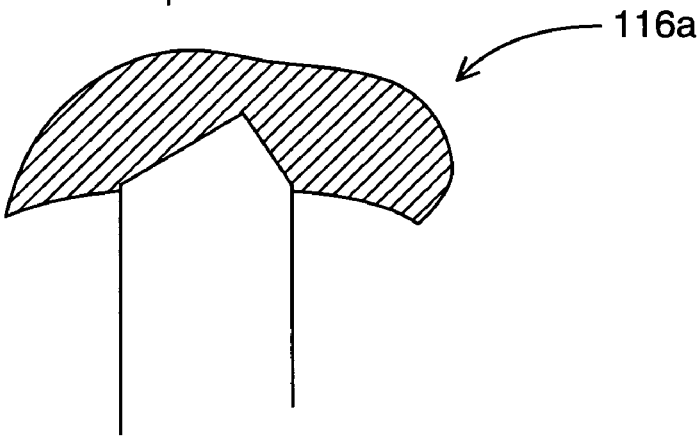

Channels 116*a*, 116*b*, 116*c*, and 116*d* are preferably formed with a substantially rectangular cross-sectional profile (FIG. 3A). However, it should be understood that channels 116*a*, 116*b*, 116*c*, and 116*d* may have various cross-sectional profiles including rectangular with rounded corners, oval, ellipse, semi or partial cylindrical (FIGS. 3B and 3C) or triangular (FIG. 3D) and other various geometries. Further, it is preferred for the width and height of each channel opening to be substantially similar to the width and height of the ends of the waveguide passages 108, 110, 112 such that channels 116*a*, 116*b*, 116*c* and 116*d* can be dimensionally aligned with waveguide passages 108,110 and 112 when rotor 106 is suitably rotated within housing 102. However, it should be understood that housing assembly 100 can still be beneficially utilized with channels 116*a*, 116*b*, 116*c*, and 116*d* having a widths and/or lengths that differ by as much as 20 to 25% from the respective widths and lengths of the ends of the waveguide passages.

Power absorbing elements 118*a*, 118*b*, 118*c*, 118*d* comprise power absorbing load material that is suited to absorb substantial amounts of electromagnetic power. Accordingly, power absorbing elements 118*a*, 118*b*, 118*c*, 118*d* change the boundary conditions for not-switched-through waveguide passages 110 (FIGS. 5A, 5C) or 108 and 112 (FIGS. 5B, 5D) in rotor 106 when passage ends are blocked by the inner surface of a housing 102. Power absorbing elements 118*a*, 118*b*, 118*c*, 118*d* positioned within channels 116*a*, 116*b*, 116*c*, 116*d* change the boundary conditions on the ends of the waveguide passages 108, 110, 112 from perfectly conductive surfaces, that fully reflect electromagnetic waves to walls that are non-conductive and absorb electromagnetic power.

Thus, passages 108, 110, 112 that previously would act as volume resonators are transformed into a piece of a waveguide transmission line loaded on both ends. Power absorbing elements 118*a*, 118*b*, 118*c*, 118*d* preferably entirely absorb the electromagnetic power of oscillations in a particular not-switched-through waveguide passage although it is also sufficient for power absorbing elements 118*a*, 118*b*, 118*c*, 118*d* to partially absorb such electromagnetic power such that the magnitude of the spurious spike on the isolation characteristic is reduced down to the noise floor. Power absorbing elements 118*a*, 118*b*, 118*c*, 118*d* is manufactured from material that functions over the same, or wider, frequency band as microwave switch 100 (e.g. MF124-500 can operate as a load element over the frequency range 1-18 GHz).

Figure 4A:
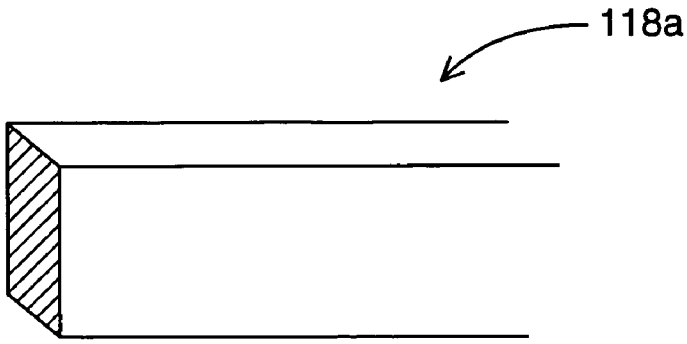
FIGS. 4A, 4B, 4C, and 4D are perspective views of various power absorbing elements utilized within the example microwave switches of FIGS. 2 and 8.
Figure 4B:
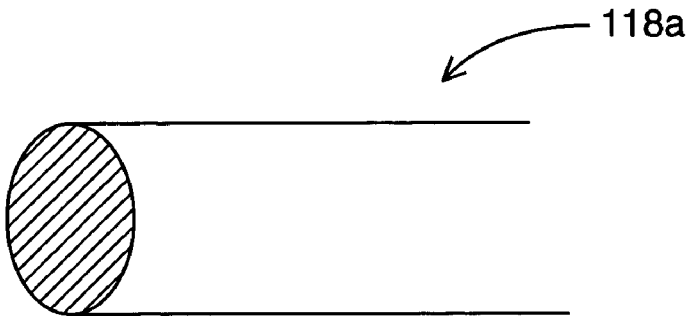
Figure 4C:
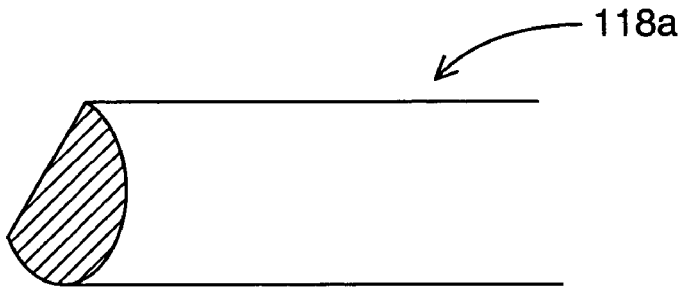
Figure 4D:
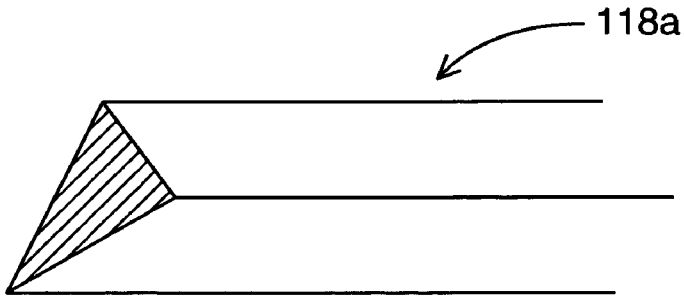

Power absorbing elements 118*a*, 118*b*, 118*c*, 118*d* are positioned within and secured within channels 116*a*, 116*b*, 116*c*, 116*d* using conventional means (e.g. bond epoxy, casting, insert molding, pressure fit, threaded mating etc.). While it is preferred to utilize power absorbing elements 118*a*, 118*b*, 118*c*, 118*d* that have a rectangular cross-section (FIG. 4A), it should be understood that the cross-section of power absorbing elements 118*a*, 118*b*, 118*c*, and 118*d* could also be of many other shapes such as cylindrical (FIG. 4B), semicircular (FIG. 4C), or square (FIG. 4D).

An important electrical parameter for waveguide switches is the measurement of isolation performance. Isolation performance is a measurement of electromagnetic signal leakage into the waveguide ports that are mutually isolated (i.e. unconnected) when the switch is in a particular position. It desirable to achieve high isolation performance within a waveguide switch assembly. Isolation performance is determined by rotor and housing configuration, number of half wavelengths in a waveguide between adjacent waveguide paths and the availability of space for choke sections.

Figure 5A:
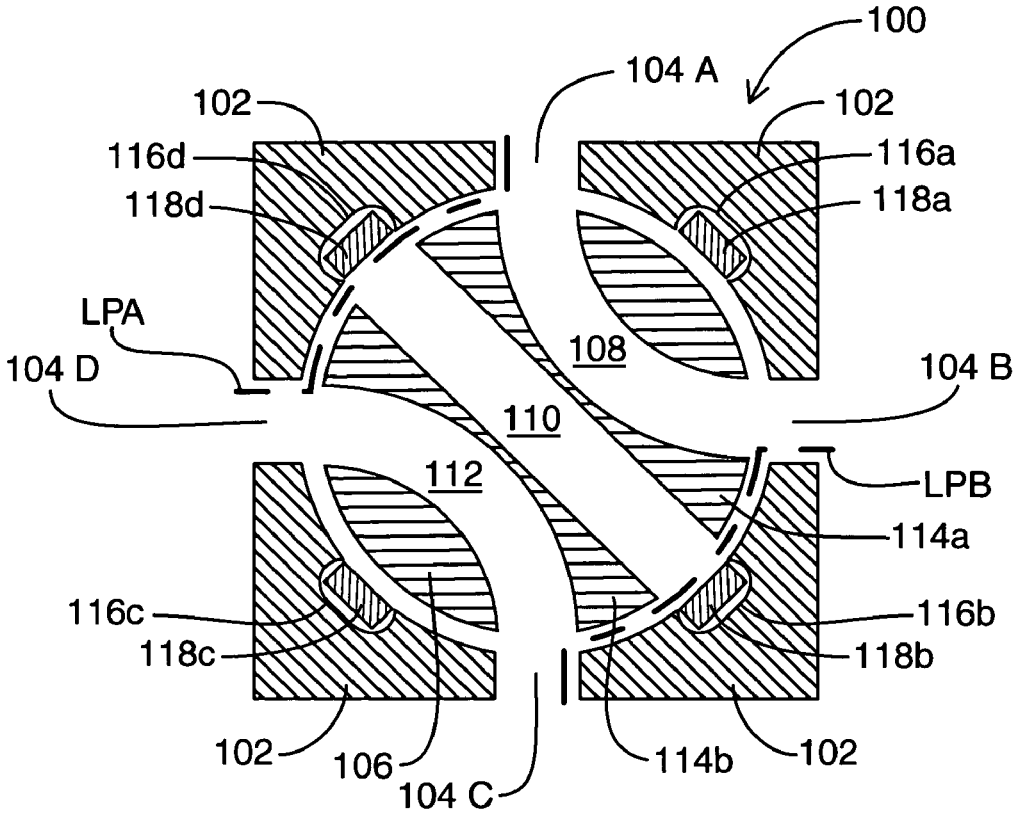
FIG. 5A is a cross-sectional view of the example microwave switch of FIG. 2 where the rotor is rotated to a first position.

As shown in FIG. 5A, a leakage path LPA as shown by dotted lines can exist between rotor 106 and the housing 102. Signal leakage will occur along the dotted line of LPA in between mutually isolated ports 104A, 104B, 104C, 104D and cause signal to enter into unconnected waveguide passages, which is in the case of FIG. 5A, waveguide passage 110. Unconnected waveguide passage 110 is restricted at both ends by the walls of housing 102. That is, the unconnected waveguide passage 110 and the adjacent walls of housing 102 form a cavity that can act as a volume resonator. The frequency of oscillation of this resonator depends on the geometrical dimensions of the resonator volume that is defined by waveguide passage 110 and housing 102 wall (i.e. width, height and length). A change in one of these dimensions will alter the frequency of oscillation. The dominant modes of the oscillation are TE101, TE102and TE201. Since the second digit of the index of these modes is "0", changes in the waveguide height will not affect the resonance frequency. However, a change in the height and/or in the width of the volume resonator will produce a change in path impedance that will cause additional reflect of the signal and as a result degradation of the return loss. Changing the length will necessitate the increase in the length of rotor 106 that introduces increased switch size, mass and manufacturing costs.

In the case where channels 116*a*, 116*b*, 116*c*, and 116*d* have a rectangular-shaped opening of substantially the same width and length as the ends of the rectangular waveguide passages 108, 110, 112, the length of the volume resonator that is associated with an unconnected waveguide passage 108, 110, 112 is effectively increased. Since the path length is increased due to the additional path length associated with channels 116*a*, 116*b*, 116*c*, 116*d*, the resonator frequency is lowered. The resonant frequency may be lowered sufficiently so that leakage of transmitted signals along the gap no longer induce the volume resonator to resonate at the operating frequency band of a switch, but in many cases a resonance still may occur, causing a spurious resonant spike as mentioned. Since power absorbing elements 118*a*, 118*b*, 118*c*, 118*d* are also present within channels 116*a*, 116*b*, 116*c*, 116*d* adjacent to unconnected waveguide passages 108, 110, 112, power absorbing elements 118*a*, 118*b*, 118*c*, 118*d* change the boundary conditions on the inner walls of housing 102 absorbing electromagnetic power that is generated by resonant frequency oscillations in the unconnected waveguide passages 108, 110, 112 and transform these waveguide passages 108, 110, 112, into a transmission line as discussed above.

For example, as shown in FIG. 5A, when waveguide passage 108 connects ports 104A and 104B and waveguide passage 112 connects ports 104C and 104D, the leakage paths LPA and LPB are created (shown as dotted lines). Since power absorbing elements 118*b* and 118*d* are positioned within leakage paths LPA and LPB adjacent to the ends of waveguide passage 110, conditions for complete reflection of electromagnetic power within the volume resonator between the walls of housing 102 no longer exist. That is, the volume resonator is transformed into a piece of a transmission line that is terminated at both ends which suppresses resonant oscillations. Accordingly, the unconnected waveguide path 110 no longer operates as a volume resonator. The result is that the spurious resonant spike within the isolation characteristic and the corresponding spike on the insertion loss characteristic both fall below the noise floor and for practical purposes are removed and improved isolation conditions between mutually unconnected ports 104A, 104B, 104C, 104D result.

Housing assembly 100 will now be described in more detail in its four main operational positions. FIG. 5A shows housing assembly 100 in a first position where rotor 106 is positioned within housing 102 such that waveguide passage 108 switched-through and connects ports 104A and 104B and waveguide passage 112 switched-through and connects ports 104C and 104D. Leakage path LPA (FIG. 5A) is created between ports 104A and 104D and leakage path LPB (FIG. 5A) is created between port 104B and 104C. Waveguide passage 110 is unconnected and restricted by the walls of housing 102, and specifically terminates at cavities 116*b*, 116*d*. As described, waveguide passage 110 and the walls of housing 102 create a cavity that can act as a volume resonator supplied by stray electromagnetic signals received from leakage paths LPA and LPB. In this first position, power absorbing elements 118*b* and 118*d* absorb electromagnetic power generated by resonant frequency oscillations in waveguide passage 110. Accordingly, the unconnected waveguide path 110 cannot operate as a volume resonator and resonant oscillations are dramatically reduced within the volume resonator. The result is that the spurious resonant spike within the isolation characteristic and the corresponding spike on the insertion loss characteristic both fall below the noise floor and for practical purposes are removed and improved isolation conditions between mutually unconnected ports 104A and 104D and 104B and 104C result.

Figure 5B:
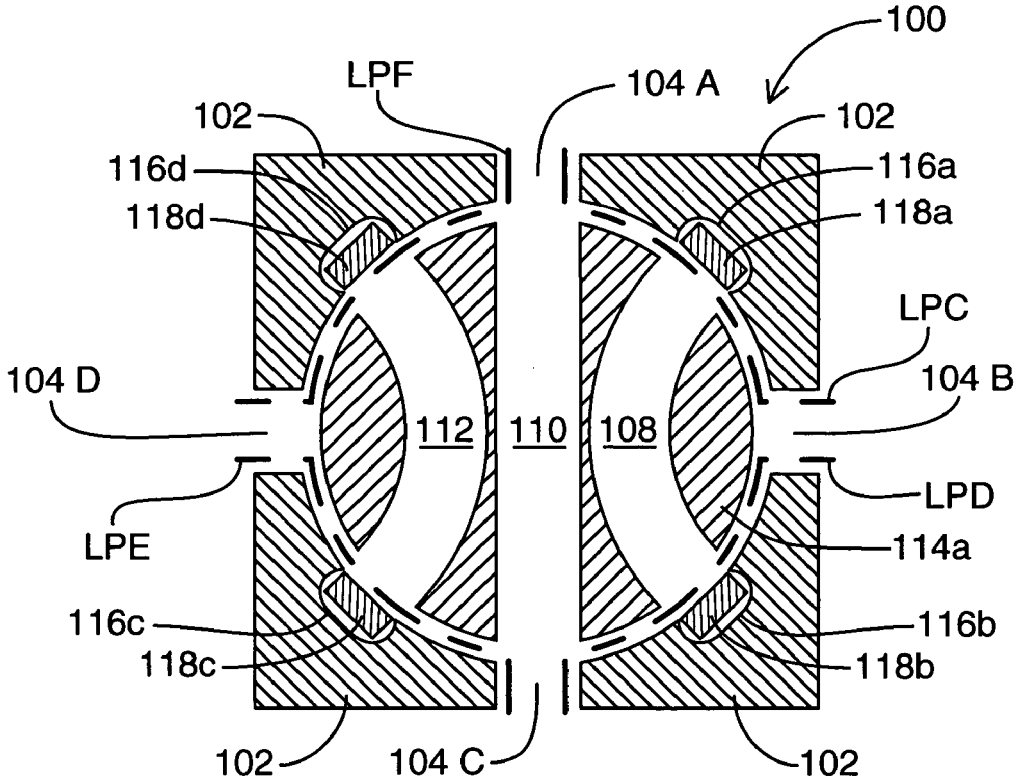
FIG. 5B is a cross-sectional view of the example microwave switch of FIG. 2, with the rotor is rotated to a second position.

FIG. 5B shows housing assembly 100 in a second position where waveguide passage 110 is switched-through and connects ports 104A and 104C. Leakage path LPC is created between ports 104A and 104B, leakage path LPD is created between port 104B and 104C, leakage path LPE is created between ports 104C and 104D, leakage path LPF is created between port 104D and 104A. Waveguide passages 108 and 112 are unconnected and restricted by the walls of housing 102, and specifically terminate at cavities 116*a*, 116*b* and 116*c*, 116*d*, respectively. As described, waveguide passages 108 and 112 and the walls of housing 102 create cavities that can act as a volume resonators supplied by stray electromagnetic signals received from leakage paths LPC, LPD and LPE, LPF, respectively. In this second position, power absorbing elements 118*a*, 118*b* and 118*c*, 118*d* absorb electromagnetic power generated by resonant frequency oscillations in waveguide passages 108 and 112, respectively. Accordingly, the unconnected waveguide paths 108 and 112 cannot operate as volume resonators and resonant oscillations are dramatically reduced within these volume resonators. The result is that the spurious resonant spike within the isolation characteristic and the corresponding spike on the insertion loss characteristic both fall below the noise floor and for practical purposes are removed and improved isolation conditions between mutually unconnected ports 104B and 104D result.

Figure 5C:
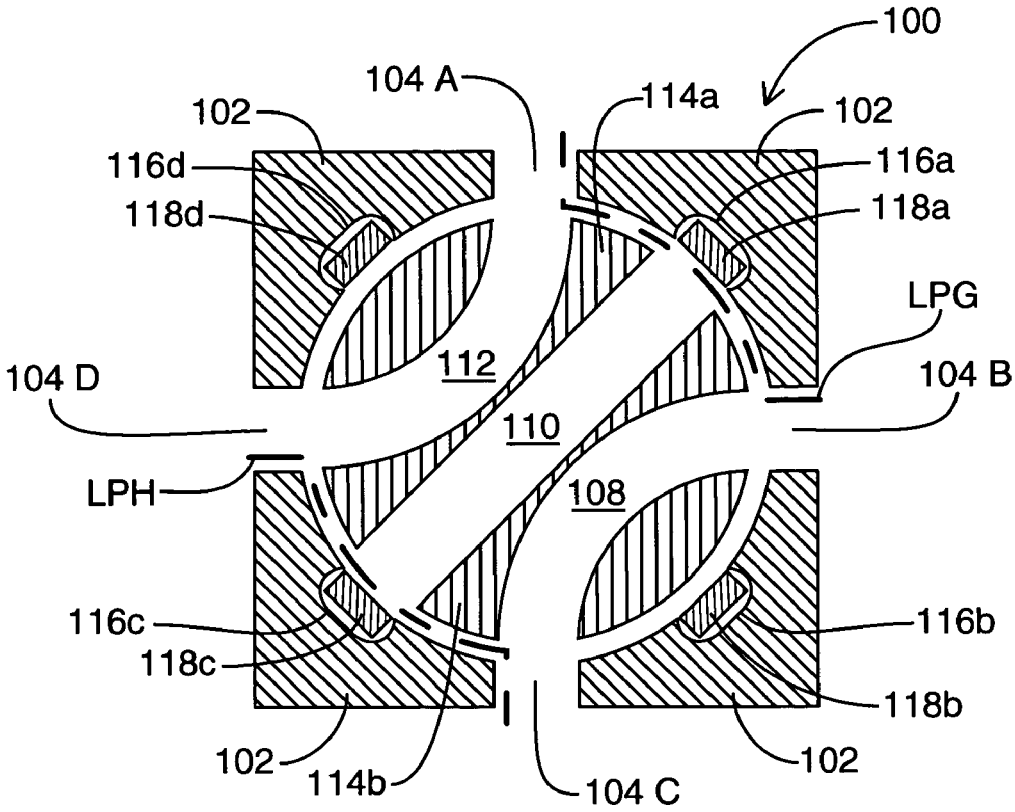
FIG. 5C is a cross-sectional view of the microwave switch of FIG. 2, with the rotor is rotated to a third position.

FIG. 5C shows housing assembly 100 in a third position where waveguide passage 108 is switched-through and connects ports 104B and 104C and waveguide passage 112 is switched-through and connects ports 104A and 104D. Leakage path LPG is created between ports 104A and 104B and leakage path LPH is created between port 104C and 104D. Waveguide passage 110 is unconnected and restricted by the walls of housing 102, and specifically terminates at cavities 116*a*, 116*c*. As described, waveguide passage 110 and the walls of housing 102 create a cavity that can act as a volume resonator supplied by stray electromagnetic signals received from leakage paths LPG and LPH. In this third position, power absorbing elements 118*a* and 118*c* absorb electromagnetic power generated by resonant frequency oscillations in waveguide passage 110. Accordingly, the unconnected waveguide path 110 cannot operate as a volume resonator and resonant oscillations are dramatically reduced within the volume resonator. The result is that the spurious resonant spike within the isolation characteristic and the corresponding spike on the insertion loss characteristic both fall below the noise floor and for practical purposes are removed and improved isolation conditions between mutually unconnected ports 104A and 104B and 104C and 104D result.

Figure 5D:
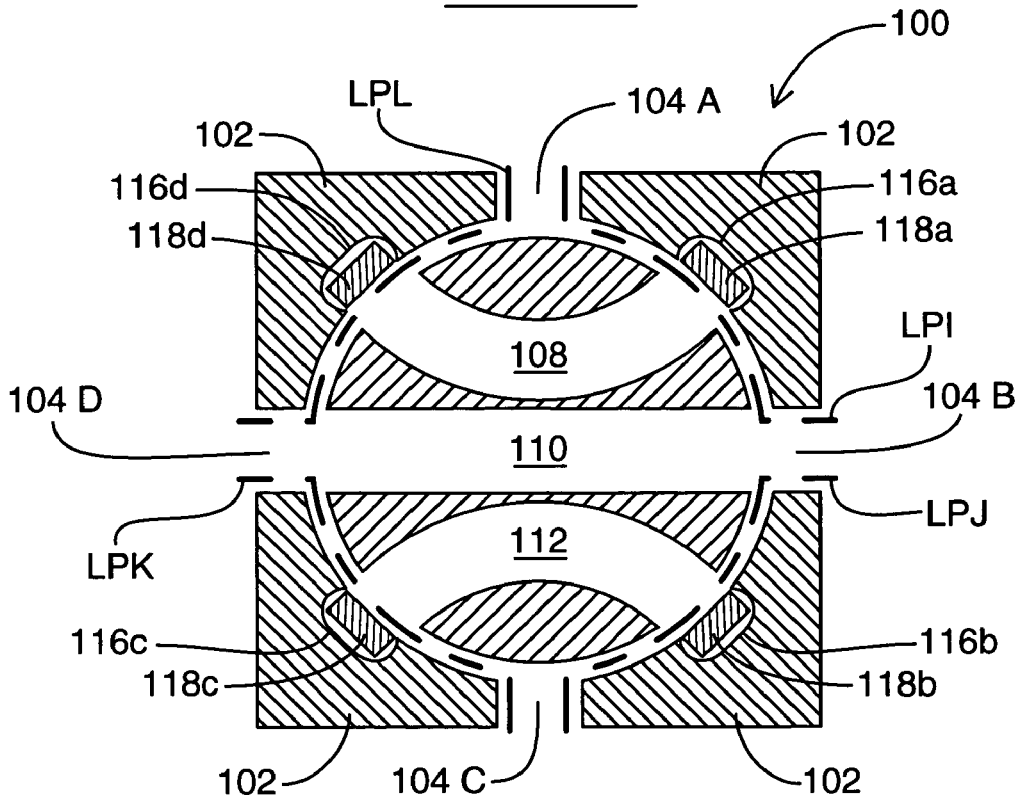
FIG. 5D is a cross-sectional view of the microwave switch of FIG. 2, with the rotor is rotated to a fourth position.

FIG. 5D shows housing assembly 100 in a fourth position where waveguide passage 110 is switched-through and connects ports 104B and 104D only. Leakage path LPI is created between ports 104A and 104B, leakage path LPJ is created between port 104B and 104C, leakage path LPK is created between ports 104C and 104D, leakage path LPL is created between port 104D and 104A. Waveguide passages 108 and 112 are unconnected and restricted by the walls of housing 102, and specifically terminate at cavities 116*a*, 116*d* and 116*b*, 116*c*, respectively. As described, waveguide passages 108 and 112 and the walls of housing 102 create cavities that can act as a volume resonators supplied by stray electromagnetic signals received from leakage paths LPI, LPL and LPJ, LPK, respectively. In this fourth position, power absorbing elements 118*a*, 118*d* and 118*b*, 118*c* absorb electromagnetic power generated by resonant frequency oscillations in waveguide passages 108 and 112, respectively. Accordingly, the unconnected waveguide paths 108 and 112 cannot operate as volume resonators and resonant oscillations are dramatically reduced within these volume resonators. The result is that the spurious resonant spike within the isolation characteristic and the corresponding spike on the insertion loss characteristic both fall below the noise floor and for practical purposes are removed and improved isolation conditions between mutually unconnected ports 104A and 104C result.

As shown in FIGS. 6A, 6B, 6C, and 6D, experiments were conducted to determine relative isolation performance as between switch assembly 100 containing microwave assembly housing 102 with and without power absorbing elements 118*a*, 118*b*, 118*c*, 118*d*. As will be discussed, the use of power absorbing elements 118*a*, 118*b*, 118*c*, 118*d* within housing 102 results in the spurious resonant spike associated with the isolation characteristic being suppressed down to the noise floor for all switch positions.

Figure 6A:
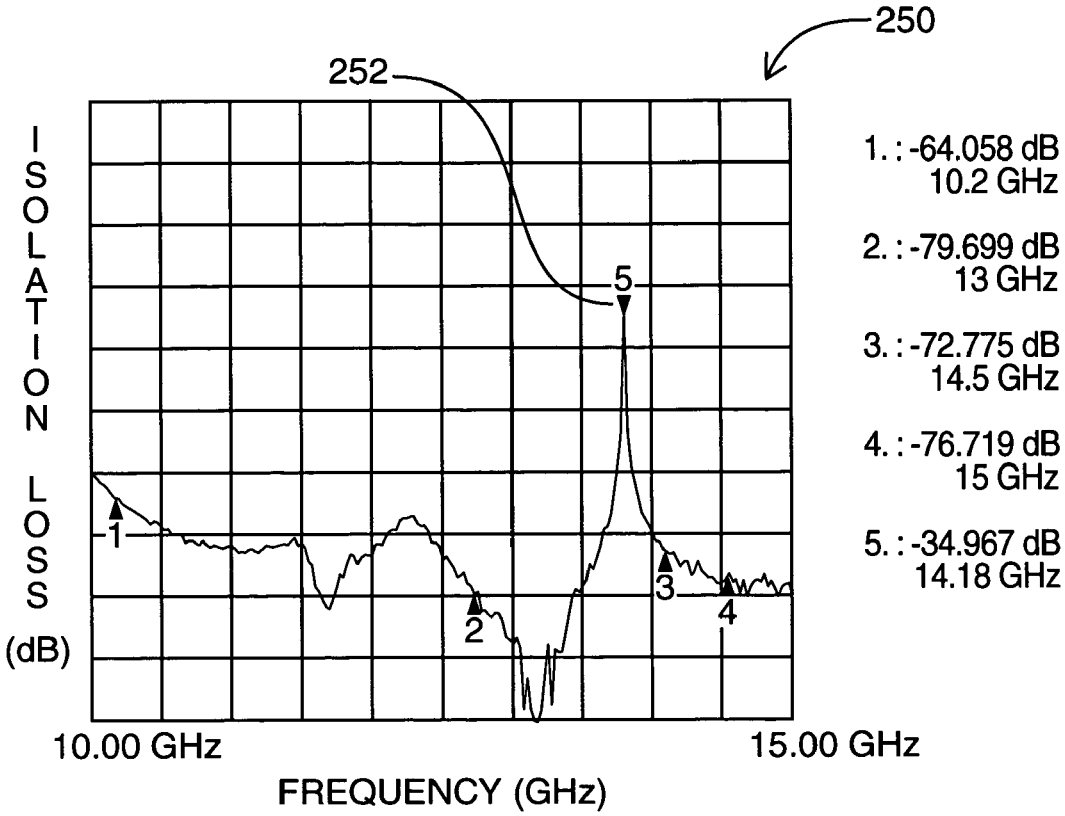
FIGS. 6A and 6B are graphs illustrating the isolation performance of the microwave R-switch of FIG. 2 in the switch positions shown in FIGS. 5A and 5C.
Figure 6B:
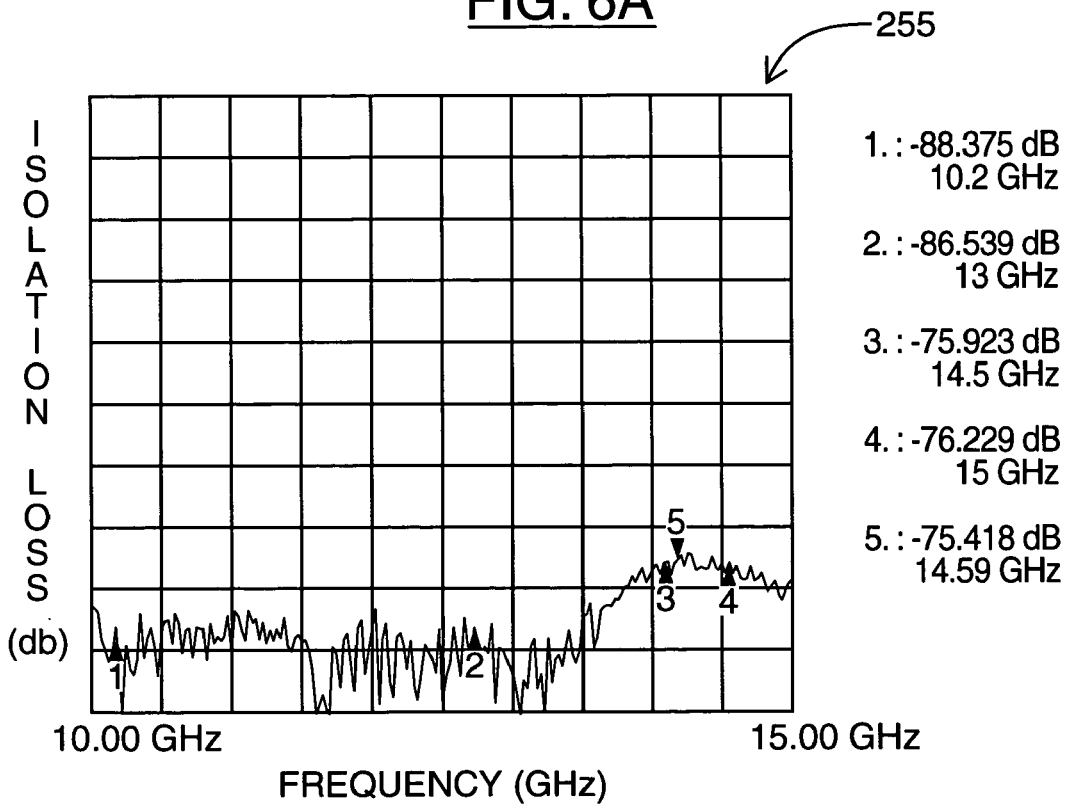

Specifically, FIG. 6A illustrates the isolation performance characteristic 250 associated with switch assembly 102 without power absorbing elements and FIG. 6B illustrates the isolation performance characteristic 255 associated with switch assembly 102 with power absorbing elements. Isolation characteristics 250 and 255 are measured when switch assembly 100 is in the first and third switch positions discussed above (e.g. in the positions shown in FIGS. 5A and 5C). In these switch positions, waveguide passages 108 and 112 are switched through and waveguide passage 110 is not-switched-through. In the first switch position (FIG. 5A) isolation performance is measured at port 104B when port 104C is the input port and 104D is the termination port and at port 104D when port 104A is the input port and 104B is the termination port. In the third switch position (FIG. 5C) isolation performance is measured at port 104B when port 104A is the input port and 104D is the termination port and at port 104D when port 104C is the input port and port 104B is the termination port. As can be seen in FIG. 6A, in the absence of power absorbing elements 118*a*, 118*b*, 118*c*, 118*d* in housing 102, a spurious spike 252 is produced within the isolation performance characteristic 250. Spurious spike 252 appears within isolation performance characteristic 250 at 14.18 GHz. As shown in FIG. 6B, when power absorbing elements 118*a*, 118*b*, 118*c*, 118*d* are utilized within housing 102, there is no discernable spurious spike within the isolation loss characteristic 250.

Figure 6C:
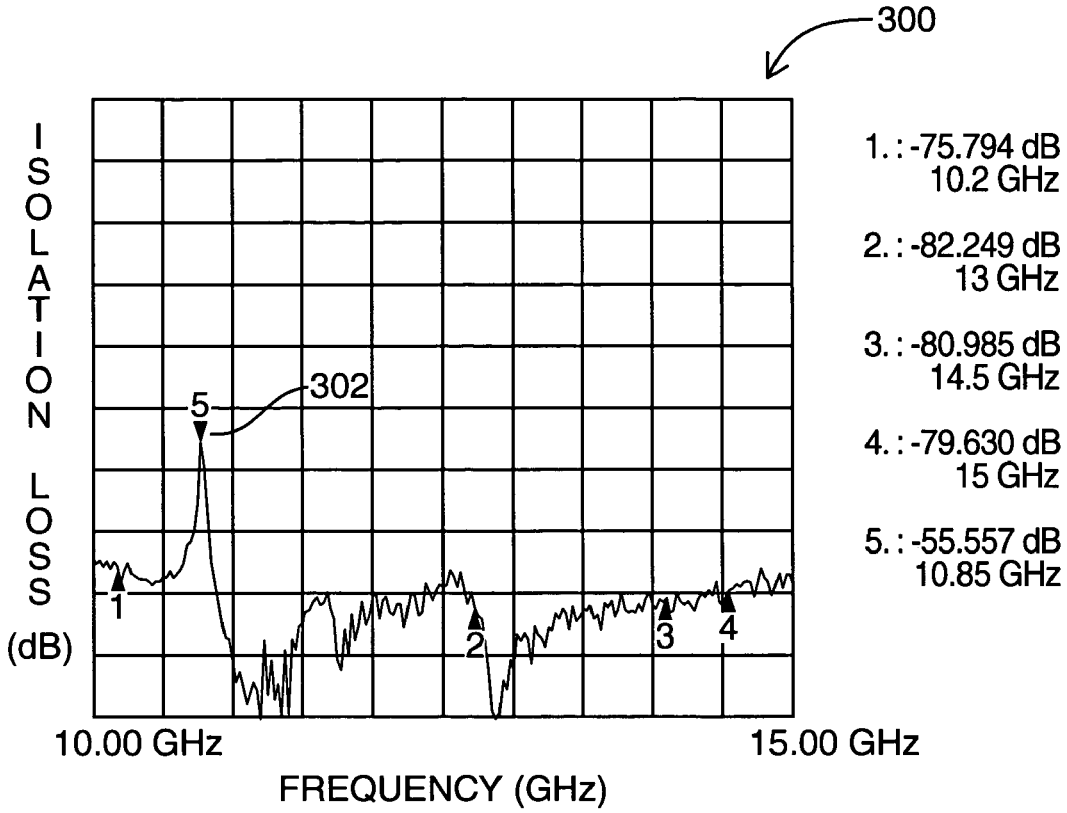
FIGS. 6C and 6D are graphs illustrating the isolation performance of the microwave R-switch of FIG. 2 in the switch positions shown in FIGS. 5B and 5D.
Figure 6D:
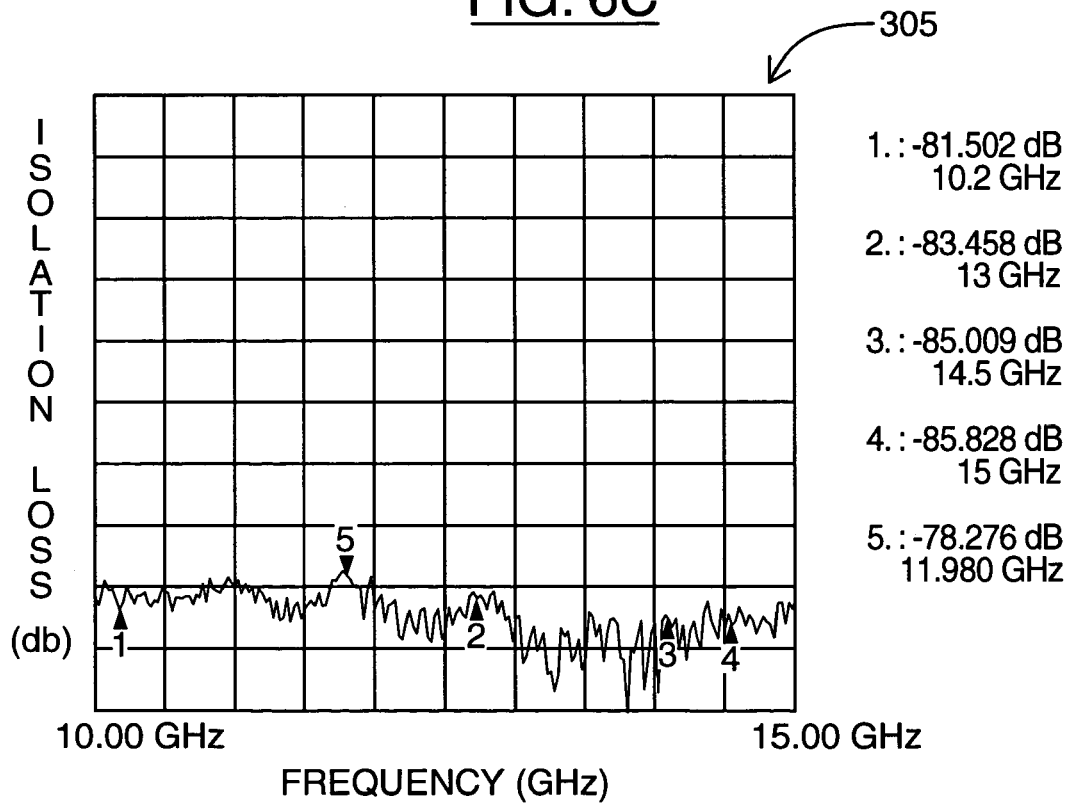

FIG. 6C illustrates the isolation performance characteristic 300 associated with switch assembly 102 without power absorbing elements and FIG. 6D illustrates the isolation performance characteristic 305 associated with switch assembly 102 with power absorbing elements. Isolation characteristics 300 and 305 are measured when switch assembly 100 is in the second and fourth switch positions discussed above (e.g. in the positions shown in FIGS. 5B and 5D) resulting in an identical isolation characteristic due to device symmetry. In these switch positions, waveguide passage 110 is switched through and waveguide passages 108, 112 are not-switched-through. In the second switch position (FIG. 5B) isolation performance is measured at port 104B or 104D when port 104A is the input port and 104C. In the fourth switch position (FIG. 5D) isolation performance is measured at port 104A or 104C when port 104D is the input port and 104B is the termination port. As can be seen in FIG. 6C, in the absence of power absorbing elements 118*a*, 118*b*, 118*c*, 118*d* in housing 102, a spurious spike 302 is produced within the isolation performance characteristic 300. Spurious spike 302 appears within isolation performance characteristic 300 at 10.85 GHz. As shown in FIG. 6D, when power absorbing elements 118*a*, 118*b*, 118*c*, 118*d* are utilized within housing 102, there is no discernable spurious spike within the isolation loss characteristic 305.

As shown in FIGS. 7A, 7B, 7C and 7D, experiments were also conducted to determine the insertion loss and return loss characteristics for housing 102 within and without power absorbing elements 118*a*, 118*b*, 118*c*, 118*d*. As will be discussed, the use of power absorbing elements 118*a*, 118*b*, 118*c*, 118*d* within housing 102 results in the spurious resonant spike associated with the insertion loss characteristic being suppressed down to the noise floor for all switch positions.

Figure 7A:
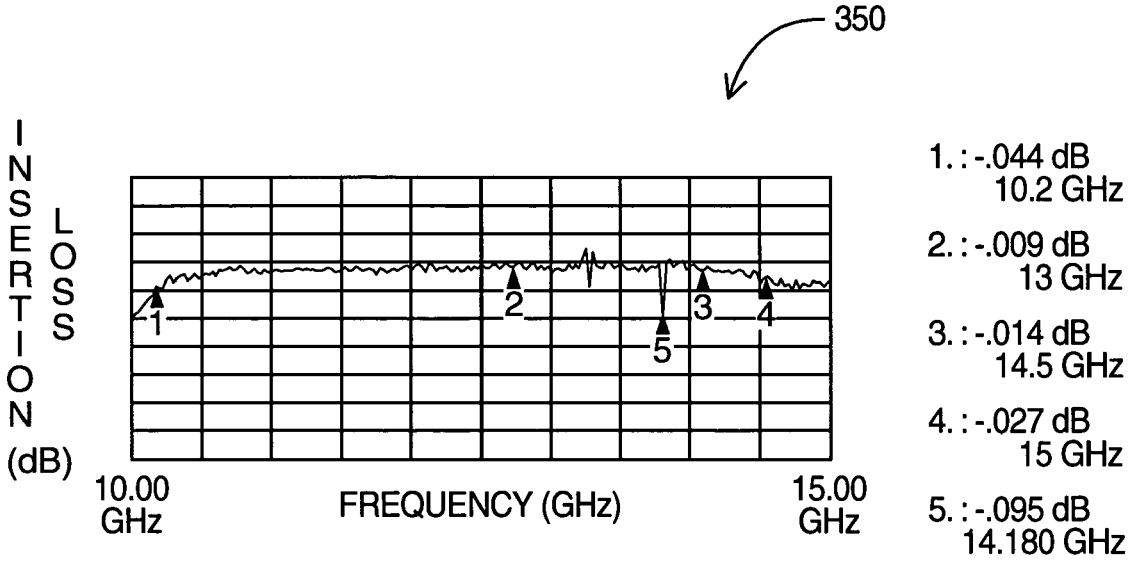
FIGS. 7A and 7B are graphs illustrating the insertion loss and return loss performance of the microwave R-switch of FIG. 2 in the switch positions shown in FIGS. 5A and 5C.
Figure 7A:
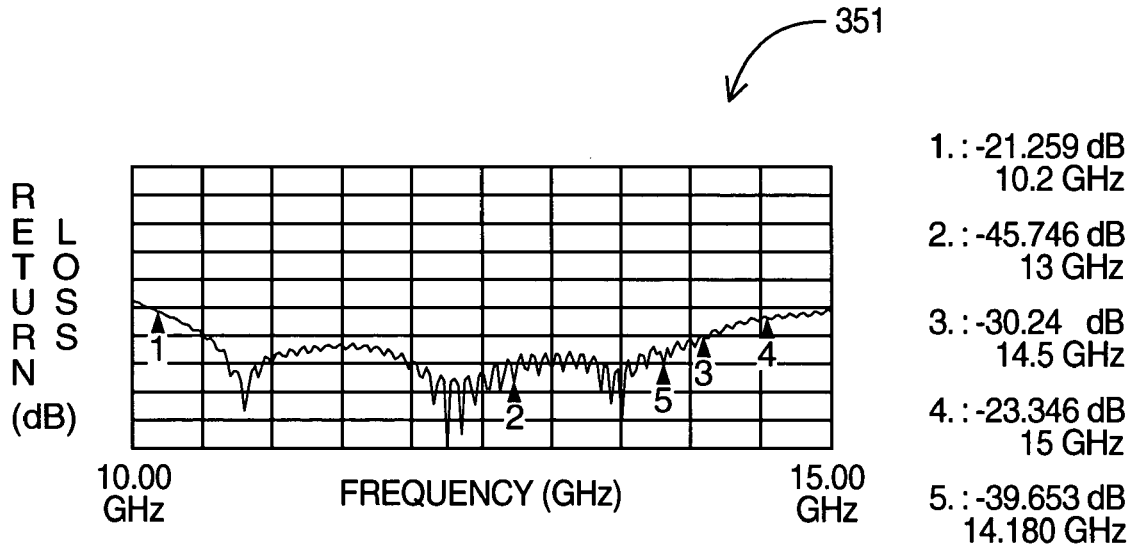
Figure 7B:
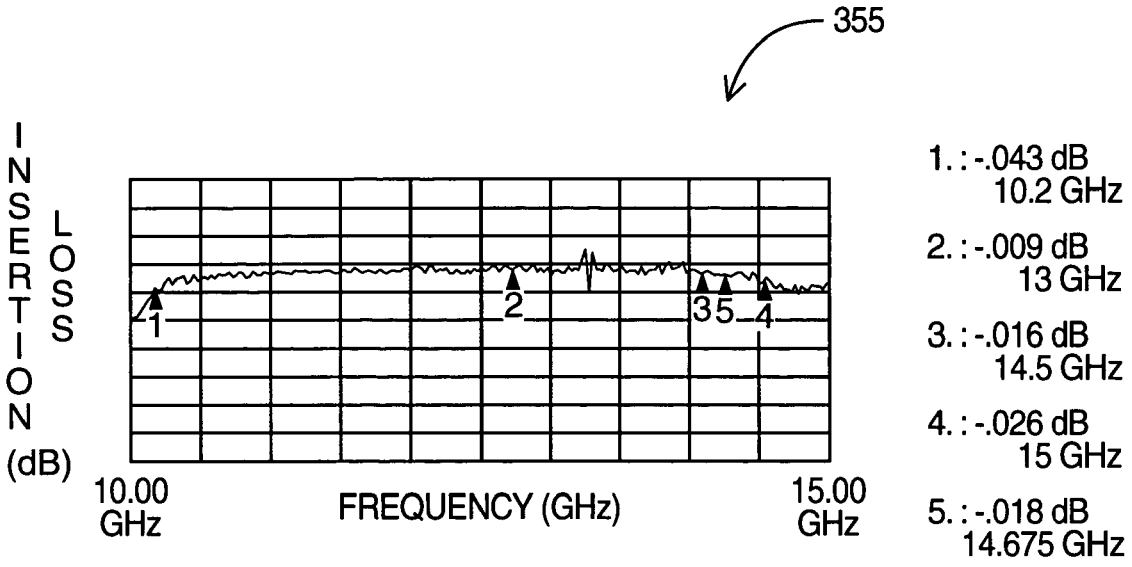
Figure 7B:
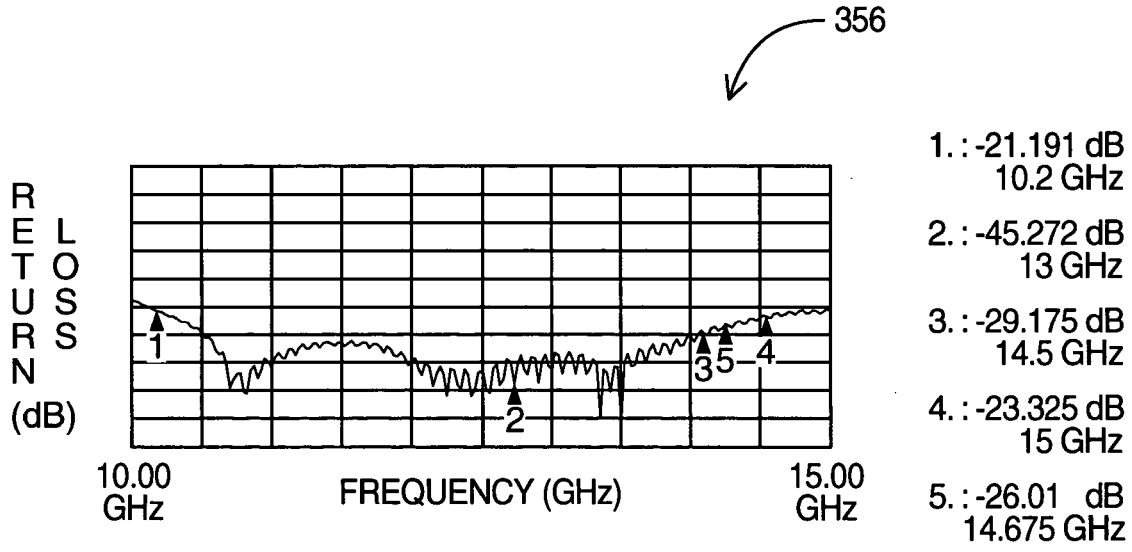

Specifically, FIG. 7A illustrates the isolation performance characteristic 350, 351 associated with switch assembly 102 without power absorbing elements and FIG. 7B illustrates the isolation performance characteristic 355, 356 associated with switch assembly 102 having power absorbing elements. Insert and return characteristics 350 and 355 are measured when switch assembly 100 is in the first and third switch positions discussed above (e.g. in the positions shown in FIGS. 5A and 5C). In these switch positions, waveguide passages and 112 are switched through and waveguide passage 110 is not-switched-through. In the first switch position (FIG. 5A), the insert and return performance characteristic is measured using 104A as the input port and 104B as the output port. In the third switch position (FIG. 5C), the insert and return performance characteristic is measured using 104B as the input port and 104C as the output port or using 104A as the input port and 104D as the output port. As can be seen in FIG. 7A, in the absence of power absorbing elements 118*a*, 118*b*, 118*c*, 118*d* in housing 102, a spurious spike 352 is produced within the isolation loss characteristic 350. Spurious spike 352 appears within isolation loss characteristic 350 at 14.18 GHz. As shown in FIG. 7B, when power absorbing elements 118*a*, 118*b*, 118*c*, 118*d* are utilized within housing 102, there is no discernable spurious spike within the isolation loss characteristic 305.

Figure 7C:
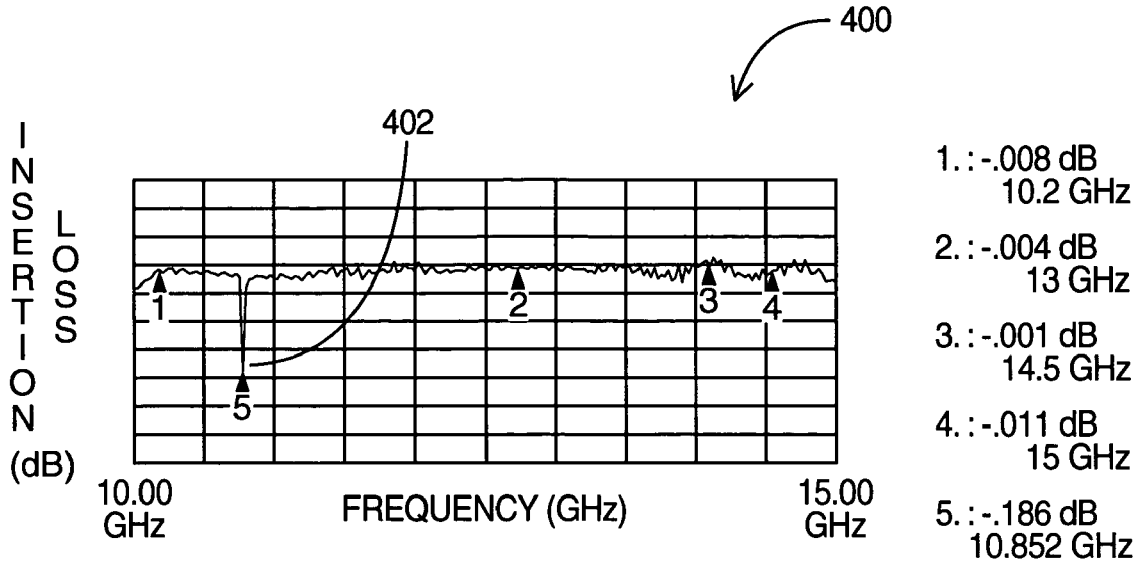
FIGS. 7C and 7D are graphs illustrating the insertion loss and return loss performance of the microwave R-switch of FIG. 2 in the switch positions shown in FIGS. 5B and 5D.
Figure 7C:
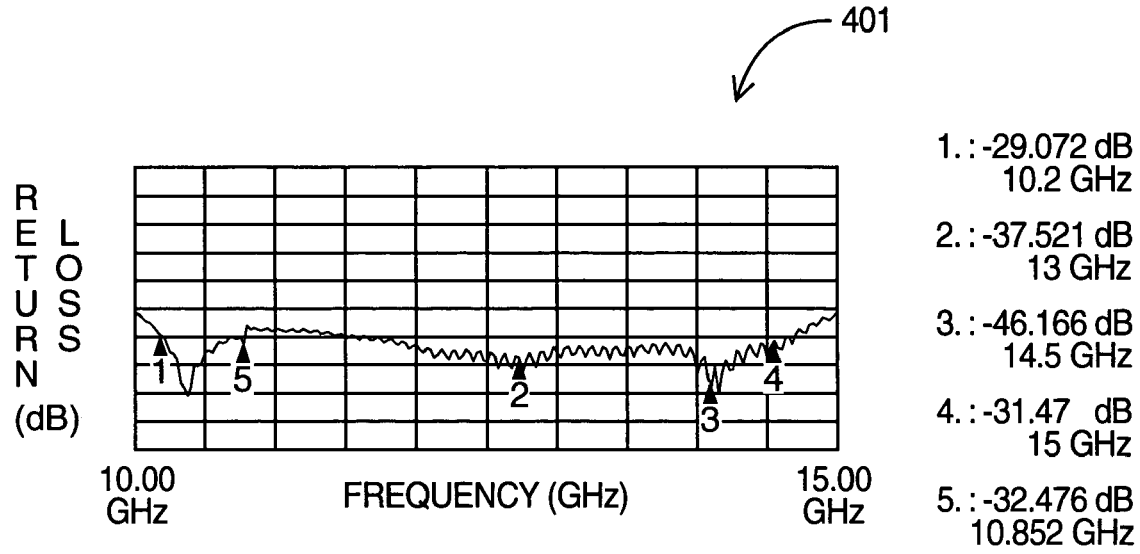
Figure 7D:
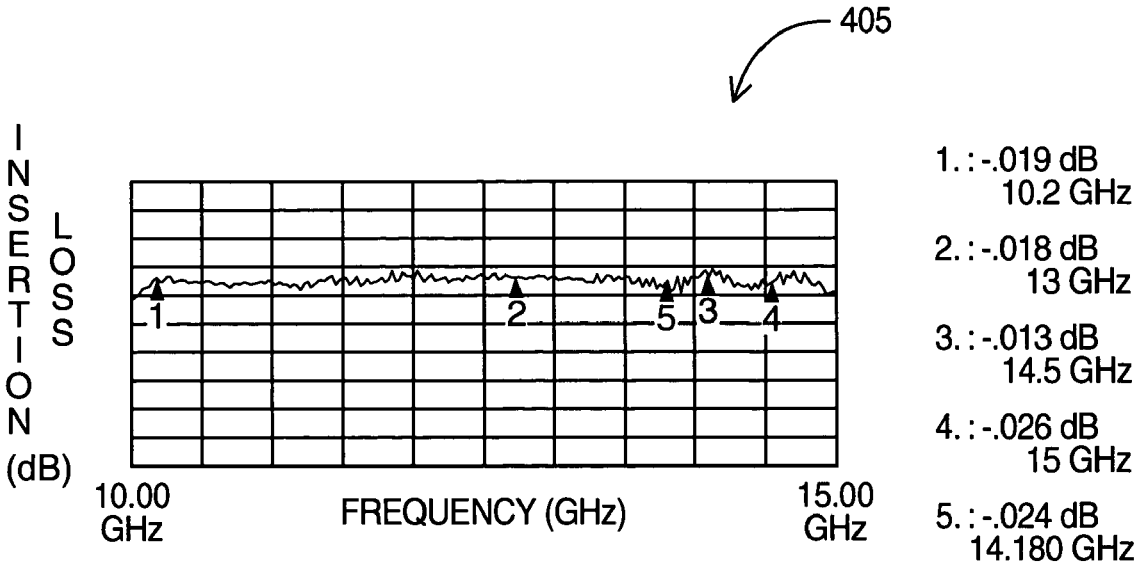
Figure 7D:
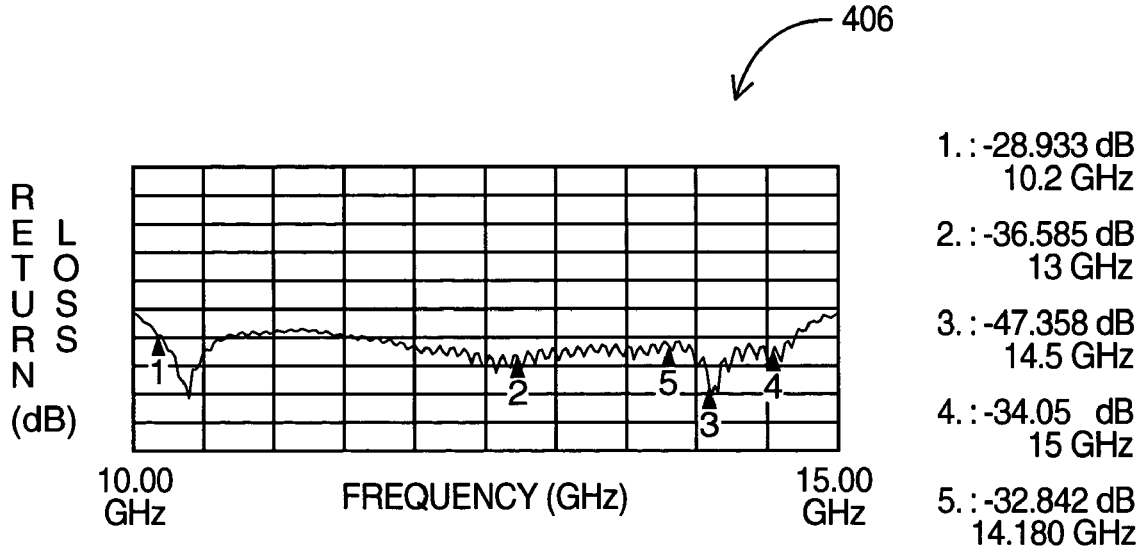

FIG. 7C illustrates the isolation performance characteristic 400, 401 associated with switch assembly 102 without power absorbing elements and FIG. 7D illustrates the isolation performance characteristic 405, 406 associated with switch assembly 102 having power absorbing elements. Isolation characteristics 400 and 405 are measured when switch assembly 100 is in the second and fourth switch positions discussed above (e.g. in the positions shown in FIGS. 5B and 5D). In these switch positions, waveguide passage 110 is switched through and waveguide passages 108, 112 are not-switched-through. In the second switch position (FIG. 5B), the insert and return performance characteristic is measured using port 104A as the input port and 104C as the output port. In the fourth switch position (FIG. 5D), the insert and return performance characteristic is measured using port 104B as the input port and 104D as the output port. As can be seen in FIG. 7C, in the absence of power absorbing elements 118*a*, 118*b*, 118*c*, 118*d* in housing 102, a spurious spike 402 is produced within the insertion loss characteristic 400. Spurious spike 402 appears within insertion loss characteristic 300 at 10.85 GHz. As shown in FIG. 7D, when power absorbing elements 118*a*, 118*b*, 118*c*, 118*d* are utilized within housing 102, there is no discernable spurious spike within the insertion loss characteristic 405.

Power absorbing elements 118*a*, 118*b*, 118*c*, and 118*d* can have various depths and widths as long as the surface of power absorbing elements 118*a*, 118*b*, 118*c*, and 118*d* that faces the internal space of housing 102 does not protrude into the internal space of housing 102. This is to ensure that the rotation of rotor 106 is not obstructed and to allow for sufficient operational clearance between the outer surface of rotor 106 and the inner surface of housing 102 in the case of temperature variations. In terms of length, it is preferred to utilize power absorbing elements 118*a*, 118*b*, 118*c*, 118*d* that have length that is substantially similar to the length of the ends of waveguide passages 108, 110, 112. That is, preferably power absorbing elements 118*a*, 118*b*, 118*c*, and 118*d* substantially fill channels 116*a*, 116*b*, 116*c*, and 116*d* lengthwise, it is possible to operate housing assembly 100 to advantage using power absorbing elements 118*a*, 118*b*, 118*c*, 118*d* that do not completely fill channels 116*a*, 116*b*, 116*c*, 116*d* and which are positioned at various positions along channels 116*a*, 116*b*, 116*c*, 116*d* (e.g. at either end or at various positions in between). It has been experimentally determined that favourable results can be obtained by using power absorbing elements 118*a*, 118*b*, 118*c*, 118*d* that are within 50 to 100% of the length of channels 116*a*, 116*b*, 116*c*, 116*d*.

Also, it should be understood that various combinations of power absorbing elements 118*a*, 118*b*, 118*c*, 118*d* of various cross-sections and channels 116*a*, 116*b*, 166*c*, 116*d* of various cross-sections are possible, such as for example, power absorbing elements 118*a*, 118*b*, 118*c*, 118*d* having square cross-sections within channels 116*a*, 116*b*, 116*c*, 116*d* of rectangular cross-section. Also, it should be understood that various combinations of power absorbing elements and channel pairs could be utilized. That is, for example, housing assembly 100 could have one channel that is of a cylindrical cross-section and another channel that is of a rectangular cross-section each with differently shaped power absorbing elements.

Figure 8:
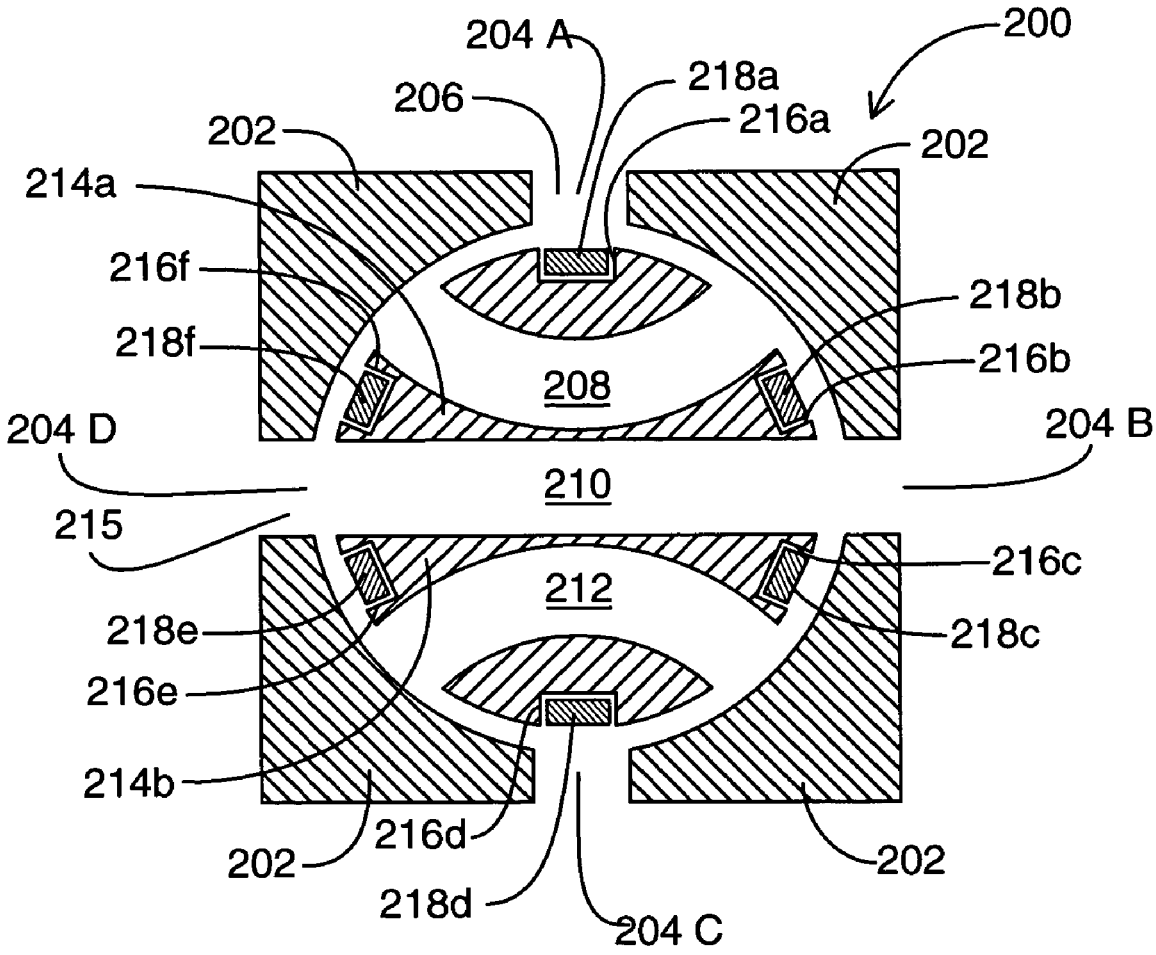
FIG. 8 is a cross-sectional view of another example microwave R-switch of the present invention.

FIG. 8 is a cross-sectional view of another example microwave R-switch housing assembly 200 built in accordance with the present invention. Common elements between housing assembly 200 and housing assembly 100 will be denoted by the same numerals but with one hundred added thereto. Microwave switch 200 includes a housing 202 having an internal open space 215 and waveguide ports 204A, 204B, 204C and 204D, and a rotor 206 disposed within the internal open space of housing 202. Rotor 206 includes waveguide passages 208, 210 and 212 that are designed to selectively line up with waveguide ports 204A, 204B, 204C and 204D as rotor 206 rotates within housing 202. In addition, longitudinal channels 216*a*, 216*b*, 216*c*, 216*d*, 216*e*, and 216*f* are formed within rotor 206 as shown in FIG. 8. Channels 216*a*, 216*b*, 216*c*, 216*d*, 216*e* and 216*f* are adapted to house power absorbing elements 218*a*, 218*b*, 218*c*, 218*d*, 218*e* and 218*f*. As rotor 206 rotates within housing 202, four predetermined switch positions can be achieved. Ports 204 that are not coupled through a waveguide path are again described as mutually isolated ports 204. Ports 204 that are coupled through a waveguide path are again described as mutually connected ports 204. Power absorbing elements 218*a*, 218*b*, 218*c*, 218*d*, 218*e*, 218*f* are positioned within channels 216*a*, 216*b*, 216*c*, 216*d*, 216*e*, 216*f* and absorb electromagnetic power propagating through the gap between rotor 206 and housing 202. The gap may act as a feeding line connecting switch ports 204A, 204B, 204C and 204D with a not-switched-through waveguide passage 208, 210, or 212 depending on the position of switch 200. A not-switched waveguide passage 208, 210, or 212 may act as a volume resonator. Power absorbing elements 218*a*, 218*b*, 218*c*, 218*d*, 218*e*, 218*f* positioned within channels 216*a*, 216*b*, 216*c*, 216*d*, 216*e*, 216*f* prevents the gap between rotor 206 and housing 202 from behaving as a feeding line and the gap does not excite resonant oscillations generated by the resonant oscillations in the non-switched-through waveguide passages 208, 210, or 212 as will be described.

It should be understood that in contrast to the switch assembly 100 of FIG. 2 where power absorbing elements 118*a*, 118*b*, 118*c*, 118*d* are used to change the boundary conditions on the ends of the not-switched-through waveguide passages 108, 110 or 112, power absorbing elements 218*a*, 218*b*, 218*c*, 218*d*, 218*e*, 218*f* of switch assembly 200 of FIG. 8, change conditions for signal propagation in the feeding line represented by the gap between rotor 206 and housing 202.

Figure 9A:
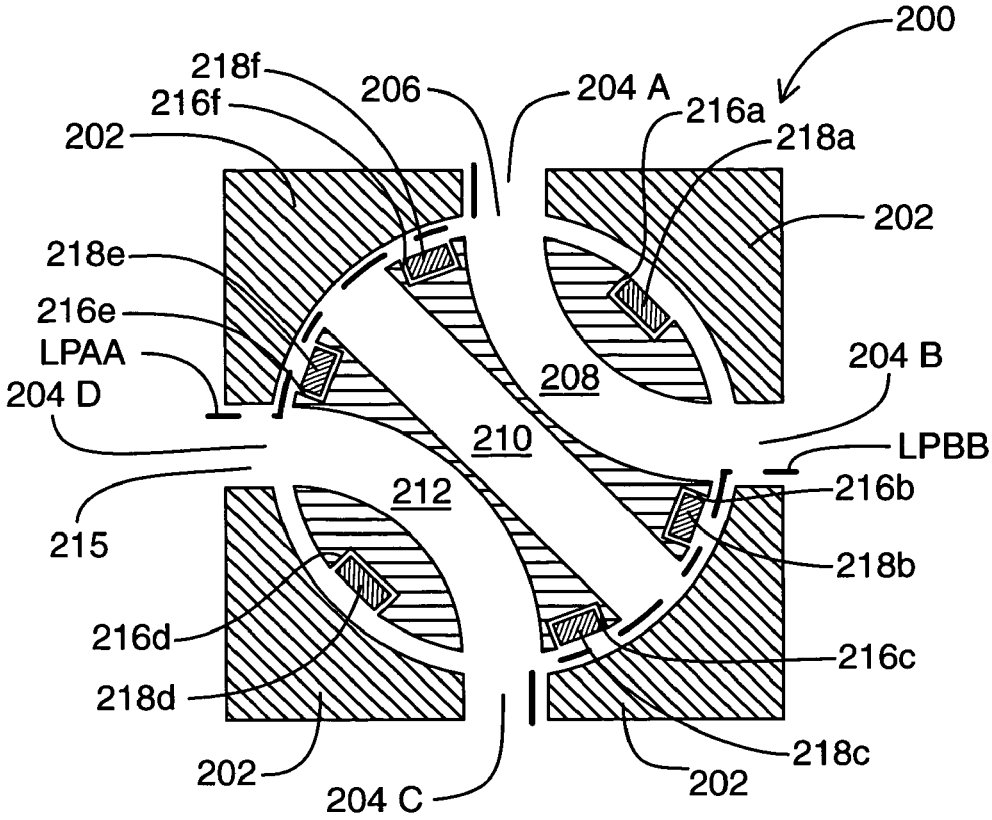
FIG. 9A is a cross-sectional view of the example microwave switch of FIG. 8 where the rotor is rotated to a first position.

Housing assembly 200 will now be described in its four main operational positions. FIG. 9A shows housing assembly 200 in a first position where rotor 206 is positioned within housing 202 such that waveguide passage 208 is switched-through and connects ports 204A and 204B and waveguide passage 212 is switched-through and connects ports 204C and 204D. A leakage path LPAA is created between ports 204A and 204D and a leakage path LPBB is created between port 204B and 204C. Waveguide passage 210 is unconnected and terminates at housing 202. In this first position, power absorbing elements 218*b*, 218*c*, 128*e* and 218*f* are positioned adjacent to the ends of unconnected waveguide passage 210 and absorb electromagnetic power propagating through the leakage paths LPAA and LPBB formed between switch ports 204A, 204D and between switch ports 204B, 204C to waveguide passage 210. Accordingly, the leakage paths no longer represent an effective transmission feeding line to excite resonant frequency oscillations in the not-switched-through waveguide passage 210. Accordingly, the unconnected waveguide path 210 cannot operate as a volume resonator and resonant oscillations are dramatically reduced within the volume resonator. The result is that the spurious resonant spike within the isolation characteristic and the corresponding spike on the insertion loss characteristic both fall below the noise floor and for practical purposes are removed. Accordingly, improved isolation conditions between mutually unconnected ports 204A and 204D and 204B and 204C result.

Figure 9B:
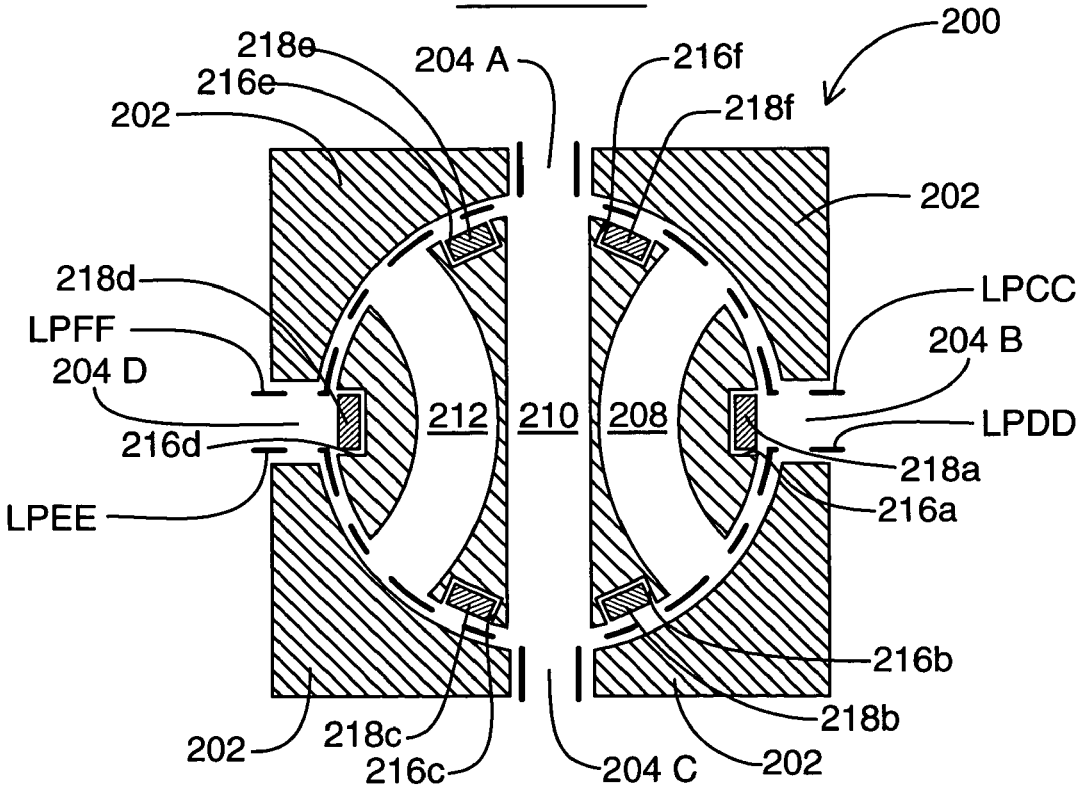
FIG. 9B is a cross-sectional view of the example microwave R-switch of FIG. 8, with the rotor is rotated to a second position.

FIG. 9B shows housing assembly 200 in a second position where waveguide passage 210 is switched-through and connects ports 204A and 204C. A leakage path LPCC is created between ports 204A and 204B, a leakage path LPDD is created between ports 204B and 204C, a leakage path LPEE is created between port 204C and 204D, and a leakage path LPFF is created between ports 204D and 204A. Waveguide passages 208 and 212 are unconnected and each is terminated at the walls of housing 202. In this second position, power absorbing elements 218*a*, 218*b*, and 218*f* are positioned adjacent to the ends of unconnected waveguide passage 208 and power absorbing elements 218*c*, 218*d*, and 128*e* are positioned adjacent to the ends of unconnected waveguide passage 212. Each of these power absorbing elements absorb electromagnetic power propagating through the leakage paths LPCC, LPDD, LPEE, and LPFF formed between switch ports 204A, 204B and switch ports 204B, 204C, switch ports 204C, 204D, and switch ports 204D, 204A to waveguide passages 208 and 212 as shown in FIG. 9B. Accordingly, the leakage paths no longer represent an effective transmission feeding line to excite resonant frequency oscillations in the not-switched-through waveguide passage 210. Accordingly, the unconnected waveguide paths 208 and 212 cannot operate as volume resonators and resonant oscillations are dramatically reduced within the volume resonator. The result is that the spurious resonant spike within the isolation characteristic and the corresponding spike on the insertion loss characteristic both fall below the noise floor and for practical purposes are removed. Accordingly, improved isolation conditions between mutually unconnected ports 204B and 204D result.

Figure 9C:
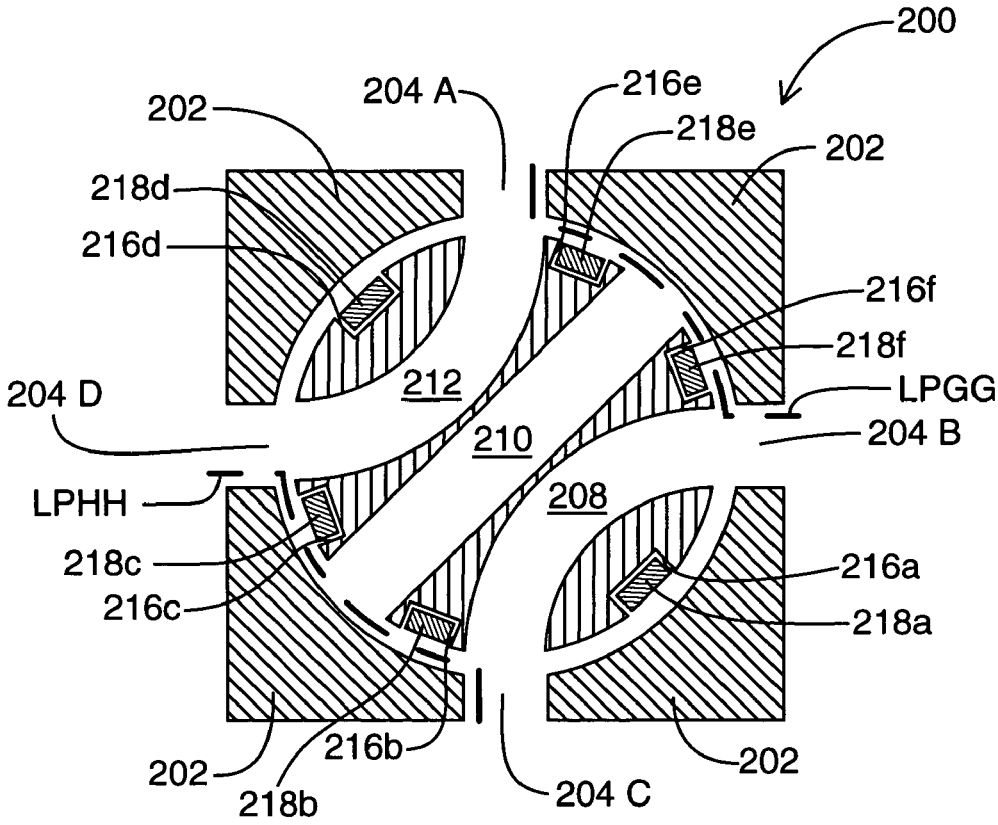
FIG. 9C is a cross-sectional view of the microwave switch of FIG. 8, with the rotor is rotated to a third position.

FIG. 9C shows housing assembly 200 in a third position where waveguide passage 208 is switched-through and connects ports 204B and 204C and waveguide passage 212 is switched-through and connects ports 204A and 204D. A leakage path LPGG is created between ports 204A and 204B and a leakage path LPHH is created between port 204C and 204D. Waveguide passage 210 is unconnected and terminates at housing 202. In this third position, power absorbing elements 218*b*, 218*c*, 218*e* and 218*f* are positioned adjacent to the ends of unconnected waveguide passage 210 and absorb electromagnetic power propagating through the leakage paths LPGG and LPHH formed between switch ports 204A, 204B and between switch ports 204C, 204D to waveguide passage 210. Accordingly, the leakage paths no longer represent an effective transmission feeding line to excite resonant frequency oscillations in the not-switched-through waveguide passage 210. Accordingly, the unconnected waveguide path 210 cannot operate as a volume resonator and resonant oscillations are dramatically reduced within the volume resonator. The result is that the spurious resonant spike within the isolation characteristic and the corresponding spike on the insertion loss characteristic both fall below the noise floor and for practical purposes are removed. Accordingly, improved isolation conditions between mutually unconnected ports 204A and 204B and 204C and 204D result.

Figure 9D:
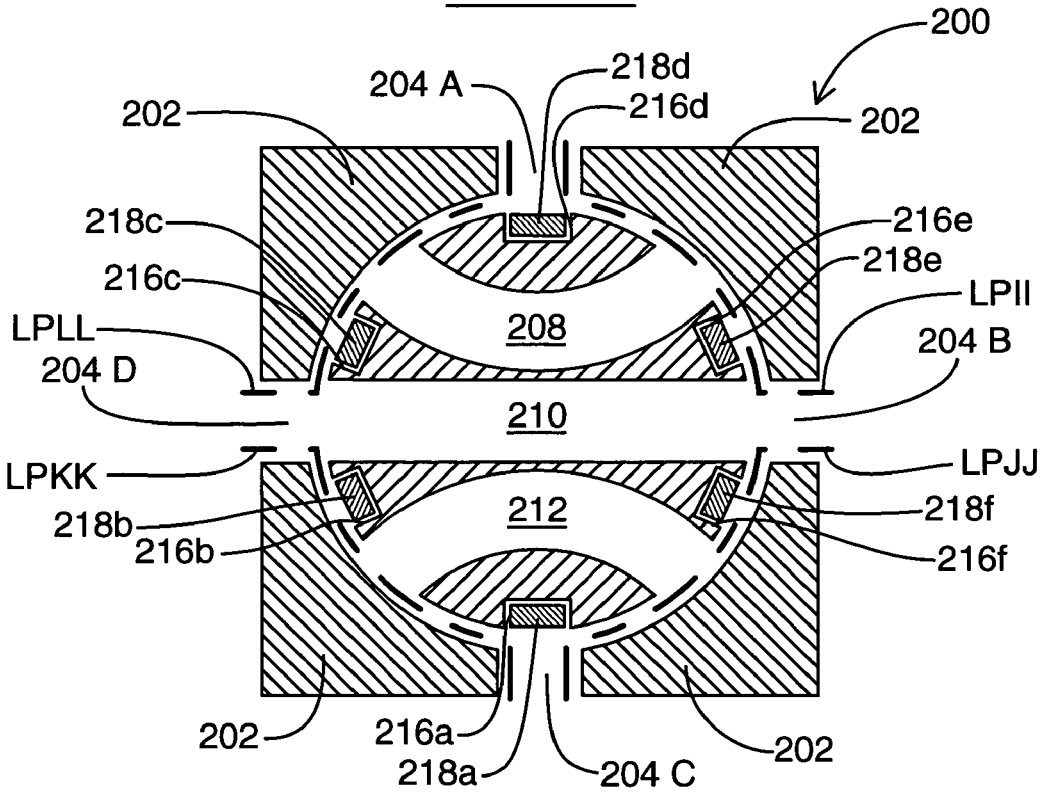
FIG. 9D is a cross-sectional view of the microwave switch of FIG. 8, with the rotor is rotated to a fourth position.

FIG. 9D shows housing assembly 200 in a fourth position where waveguide passage 210 is switched-through and connects ports 204B and 204D. A leakage path LPII is created between ports 204A and 204B, a leakage path LPJJ is created between ports 204B and 204C, a leakage path LPKK is created between port 204C and 204D, and a leakage path LPLL is created between ports 204D and 204A. Waveguide passages 208 and 212 are unconnected and each terminate at the walls of housing 202. In this second position, power absorbing elements 218*a*, 218*b*, and 228*f* are positioned adjacent to the ends of unconnected waveguide passage 208 and power absorbing elements 218*c*, 218*d*, and 128*e* are positioned adjacent to the ends of unconnected waveguide passage 212. Each of these power absorbing elements absorb electromagnetic power propagating through the leakage paths LPII, LPJJ, LPKK, and LPLL formed between switch ports 204A, 204B and switch ports 204B, 204C, switch ports 204C, 204D, and switch ports 204D, 204A to waveguide passages 208 and 212 as shown in FIG. 9D. Accordingly, the leakage paths no longer represent an effective transmission feeding line to excite resonant frequency oscillations in the not-switched-through waveguide passages 208, 212. Accordingly, the unconnected waveguide paths 208 and 212 cannot operate as volume resonators and resonant oscillations are dramatically reduced within the volume resonator. The result is that the spurious resonant spike within the isolation characteristic and the corresponding spike on the insertion loss characteristic both fall below the noise floor and for practical purposes are removed. Accordingly, improved isolation conditions between mutually unconnected ports 204A and 204C result.

While the channels 116*a*, 116*b*, 116*c*, 116*d* of housing assembly 100 have been described as being provided within housing 102 and while channels 216*a*, 216*b*, 216*c*, 216*d*, 216*e*, 216*f* have been described as being provided within rotor 206, it should be understood that it is possible to combine these approaches. Specifically, housing assembly could include some channels within the housing and some in the rotor, positioned in such a way that the power absorbing elements housed within channels would be positioned adjacent one end of an unconnected waveguide passage.

Also, it should be understood that the above discussion of the present invention has only referred, for simplicity, to the specific example of a four-port R-switch having three waveguide passages. It will be obvious to persons of ordinary skill in the art how to modify the embodiments to R-switches having a different number of ports and/or a different number or shape of waveguides. Also, it should be understood that the underlying invention could be applied to any other type of microwave switch including, but not limited to, C-switches, T-switches, SPDT switches. Such modifications are intended to be within the scope of the present invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A microwave switch housing assembly for operation in a selected frequency range, comprising:

(a) a housing;

(b) a rotor rotatably mounted within said housing;

(c) at least one waveguide passage in said rotor;

(d) said housing having ports formed therein so that in a first position of said rotor, said waveguide passage connects said ports and in a second position of said rotor, said waveguide passage is unconnected to said ports;

(e) a channel formed within one of said housing and said rotor such that said channel is positioned adjacent to one end of said waveguide passage when said rotor is in said second position;

(f) a said power absorbing element positioned and secured within said channel, a side of said power absorbing element being aligned with one of the inner radius of the housing and the outer radius of the rotor being capable of absorbing electromagnetic energy in said frequency range, so as to reduce the tendency of said waveguide passage to act as a volume resonator when said rotor is in said second position.

2. The microwave switch housing assembly of claim 1, wherein said housing has an interior opening to accommodate said rotor, said opening having a cylindrical surface, said cylindrical surface having said channel therein.

3. The microwave switch housing assembly of claim 2, wherein said waveguide passage has an end opening having a selected height and width, and said channel has substantially the same height and width as said selected height and width.

4. The microwave switch housing assembly of claim 2, wherein said waveguide passage has two end openings, and wherein said power absorbing element is positioned in said housing adjacent to at least one of said end openings when said rotor is in said second position.

5. The microwave switch housing assembly of claim 2, wherein said channel has a cross-section selected from the group consisting of: rectangular, cylindrical, and triangular.

6. The microwave switch housing assembly of claim 2, wherein said power absorbing element has a cross-section selected from the group consisting of: rectangular, cylindrical, and triangular.

7. The microwave switch housing assembly of claim 1, wherein said rotor has a plurality of curved outer surfaces, at least one of said curved outer surfaces having said channel.

8. The microwave switch housing assembly of claim 7, wherein said waveguide passage has an end opening having a selected height, and said channel has a height that is substantially the same height as said selected height.

9. The microwave switch housing assembly of claim 7, wherein said waveguide passage has two end openings, and wherein said power absorbing element is positioned in said housing adjacent to at least one of said end openings when said rotor is in said second position.

10. The microwave switch housing assembly of claim 7, wherein said channel has a cross-section selected from the group consisting of: rectangular, cylindrical, and triangular.

11. The microwave switch housing assembly of claim 7, wherein said power absorbing element has a cross-section selected from the group consisting of: rectangular, cylindrical, and triangular.

12. A microwave switch housing assembly for operation in a selected frequency range, comprising:

(a) a housing;

(b) a rotor rotatably mounted within said housing; (c) at least one waveguide passage in said rotor;

(d) said housing having ports formed therein so that in a first position of said rotor, said waveguide passage connects said ports and in a second position of said rotor, said waveguide passage is unconnected to said ports, said housing having a channel formed therein;

(e) a power absorbing element positioned and secured within said channel, a side of said power absorbing element being aligned with one of the inner radius of the housing and the outer radius of the rotor being capable of absorbing electromagnetic energy in said frequency range, said power absorbing element and channel positioned adjacent to one end of said waveguide passage and aligned therewith when said rotor is in said second position, to change the boundary conditions for said waveguide passage in said second position so as to reduce the tendency of said waveguide passage to act as a volume resonator when said rotor is in said second position.

13. The microwave switch housing assembly of claim 12, wherein said housing has an interior opening to accommodate said rotor, said opening having a cylindrical surface, said cylindrical surface having said a channel.

14. The microwave switch housing assembly of claim 12, wherein said waveguide passage has an end opening having a selected height and width, and said channel has substantially the same height and width as said selected height and width.

15. The microwave switch housing assembly of claim 12, wherein said waveguide passage has two end openings, and wherein said power absorbing element is positioned in said housing adjacent to at least one of said end openings when said rotor is in said second position.

16. The microwave switch housing assembly of claim 12, wherein said channel has a cross-section selected from the group consisting of: rectangular, cylindrical, and triangular.

17. The microwave switch housing assembly of claim 12, wherein said power absorbing element has a cross-section selected from the group consisting of: rectangular, cylindrical, and triangular.

* * * * *

UNITED STATES PATENT AND TRADEMARK OFFICE

CERTIFICATE OF CORRECTION

PATENT NO. : 7,330,087 B2
APPLICATION NO. : 10/787312
DATED : February 12, 2008
INVENTOR(S) : Evgeni Gorovoy and Jeffrey M. Wiesel It is certified that error appears in the above-identified patent and that said Letters Patent is hereby corrected as shown below:

Column 13, line 44, claim 1, the phrase "a said power" has been changed to --said power--.

Column 14, line 49, claim 13, the phrase "said a channel" has been changed to --said channel--.

Signed and Sealed this

Eleventh Day of August, 2009

David J. Kappos

David J. Kappos
*Director of the United States Patent and Trademark Office*